US011578560B2

(12) United States Patent
Zavala et al.

(10) Patent No.: US 11,578,560 B2
(45) Date of Patent: Feb. 14, 2023

(54) SETTING TOOL FOR A LINER HANGER

(71) Applicant: Weatherford Technology Holdings, LLC, Houston, TX (US)

(72) Inventors: Jose V. Zavala, Katy, TX (US); Zach Trine, Houston, TX (US); Mark J. Murray, Sugar Land, TX (US)

(73) Assignee: Weatherford Technology Holdings LLC, Houston, TX (US)

( * ) Notice: Subject to any disclaimer, the term of this patent is extended or adjusted under 35 U.S.C. 154(b) by 0 days.

(21) Appl. No.: 16/656,198

(22) Filed: Oct. 17, 2019

(65) Prior Publication Data

US 2021/0115757 A1 Apr. 22, 2021

(51) Int. Cl.

| | |
|---|---|
| ***E21B 34/06*** | (2006.01) |
| ***E21B 33/12*** | (2006.01) |
| ***E21B 23/01*** | (2006.01) |
| ***E21B 33/128*** | (2006.01) |
| ***E21B 33/14*** | (2006.01) |
| ***E21B 43/10*** | (2006.01) |

(52) U.S. Cl.

CPC ..... *E21B 34/063* (2013.01); *E21B 23/01* (2013.01); *E21B 33/128* (2013.01); *E21B 33/14* (2013.01); *E21B 43/10* (2013.01); *E21B 2200/06* (2020.05)

(58) Field of Classification Search

CPC ..... E21B 43/063; E21B 33/14; E21B 33/128; E21B 43/10; E21B 34/063

USPC ..... 166/285

See application file for complete search history.

(56) References Cited

U.S. PATENT DOCUMENTS

| | | | |
|---|---|---|---|
| 5,241,023 | A | 8/1993 | Brule et al. |
| 5,360,069 | A | 11/1994 | Schmuck et al. |
| 5,582,253 | A | 12/1996 | Fraser |
| 5,813,458 | A | 9/1998 | Smith, Jr. et al. |
| 5,839,866 | A | 11/1998 | Moen et al. |
| 6,053,244 | A | 4/2000 | Dybevik et al. |
| 6,065,536 | A | 5/2000 | Gudmestad et al. |
| 6,241,018 | B1 | 6/2001 | Eriksen |
| 6,408,945 | B1 | 6/2002 | Telfer |
| 6,467,547 | B2 | 10/2002 | Maguire et al. |

(Continued)

FOREIGN PATENT DOCUMENTS

| | | | |
|---|---|---|---|
| EP | 2873801 | A1 | 5/2015 |
| WO | 2002097234 | A1 | 12/2002 |

(Continued)

OTHER PUBLICATIONS

International Search Report and Written Opinion in related applicaiton PCT/.US2020/055501 dated Feb. 2, 2021.

(Continued)

*Primary Examiner* — William D Hutton, Jr.
*Assistant Examiner* — Ashish K Varma
(74) *Attorney, Agent, or Firm* — Smith IP Services P.C.

(57) ABSTRACT

A liner string includes a liner hanger assembly and a liner hanger deployment assembly. The liner hanger assembly includes a liner hanger. The liner hanger includes a plurality of slips and a liner hanger actuation assembly configured to set the plurality of slips. The liner hanger deployment assembly is disposed within the liner hanger assembly. The liner hanger deployment assembly includes a setting tool configured to selectively allow fluid communication between a central bore of the setting tool and the liner hanger actuation assembly.

20 Claims, 17 Drawing Sheets

(56) References Cited

U.S. PATENT DOCUMENTS

| | | | | |
|---|---|---|---|---|
| 6,571,880 | B1 * | 6/2003 | Butterfield, Jr. | E21B 33/068 166/193 |
| 6,681,860 | B1 | 1/2004 | Yokley et al. | |
| 6,739,398 | B1 | 5/2004 | Yokley et al. | |
| 6,907,936 | B2 | 6/2005 | Fehr et al. | |
| 7,114,573 | B2 | 10/2006 | Hirth et al. | |
| 7,182,135 | B2 * | 2/2007 | Szarka | E21B 33/16 166/265 |
| 7,225,870 | B2 | 6/2007 | Pedersen et al. | |
| 7,533,727 | B2 | 5/2009 | Barton et al. | |
| 7,748,760 | B2 | 7/2010 | Kushida et al. | |
| 7,766,088 | B2 | 8/2010 | Saucier et al. | |
| 8,181,701 | B2 | 5/2012 | Yokley et al. | |
| 8,327,930 | B2 * | 12/2012 | Rondeau | E21B 33/05 166/153 |
| 8,393,401 | B2 | 3/2013 | Yokley et al. | |
| 8,534,368 | B2 | 9/2013 | Reimert et al. | |
| 8,997,858 | B2 | 4/2015 | Tom | |
| 9,068,413 | B2 | 6/2015 | Doane | |
| 9,068,414 | B2 | 6/2015 | Doane | |
| 9,074,437 | B2 | 7/2015 | Stingerie et al. | |
| 9,080,404 | B2 | 7/2015 | Kalb et al. | |
| 9,217,309 | B2 | 12/2015 | Kalb et al. | |
| 9,243,492 | B2 | 1/2016 | Fraser | |
| 9,267,348 | B2 | 2/2016 | Ingram et al. | |
| 9,322,235 | B2 | 4/2016 | Turley et al. | |
| 9,428,998 | B2 | 8/2016 | Turley et al. | |
| 9,518,452 | B2 | 12/2016 | Turley et al. | |
| 9,650,854 | B2 | 5/2017 | Devarajan et al. | |
| 9,771,793 | B2 | 9/2017 | Fraser et al. | |
| 9,816,357 | B2 | 11/2017 | Abraham | |
| 9,995,099 | B2 | 6/2018 | Halfmann | |
| 10,012,046 | B2 | 7/2018 | Ewing et al. | |
| 10,273,780 | B2 | 4/2019 | Garcia et al. | |
| 10,301,907 | B2 | 5/2019 | Budde | |
| 2008/0257560 | A1 | 10/2008 | Brisco et al. | |
| 2009/0272544 | A1 | 11/2009 | Giroux et al. | |
| 2012/0175133 | A1 * | 7/2012 | Nikiforuk | E21B 33/16 166/386 |
| 2012/0222861 | A1 | 9/2012 | Eriksen | |
| 2014/0196912 | A1 * | 7/2014 | Turley | E21B 43/10 166/382 |
| 2014/0305662 | A1 | 10/2014 | Giroux et al. | |
| 2016/0230505 | A1 | 8/2016 | Garcia et al. | |
| 2016/0326832 | A1 | 11/2016 | Watson et al. | |
| 2018/0223615 | A1 | 8/2018 | Luke et al. | |

FOREIGN PATENT DOCUMENTS

| | | | |
|---|---|---|---|
| WO | 2004083590 | A2 | 9/2004 |
| WO | 2015156819 | A1 | 10/2015 |

OTHER PUBLICATIONS

Invitation to Pay Additional Fees in related application PCT/US2020/055501 dated Dec. 19, 2020.

Examination Report in related application GC 2020-40674 dated Aug. 11, 2021.

International Search Report and Written Opinion in application PCT/US2021/022183 dated Jun. 22, 2021.

Weatherford; Weatherford Direct; Product catalogue; pp. 1-203 (Kobe Knockout Plug, pp. 91, 166); retrieved from the internet:<https://www.weatherforddirect.com/weatherford/groups/public/documents/weatherforddirect/wft_direct_sdc_catalog.pdf>.

Non-Final Office Action in US 20210310338 dated Jan. 19, 2022.

Weatherford; Liner Systems; Product catalogue; 2 pages (Weatherford Premium Hydraulic-Rotating (WPHR) Liner Hanger; retrieved from the Internet: https://www.weatherford.com/documents/technical-specification-sheet/products-and-services/drilling/wphr-liner-hanger/.

* cited by examiner

SETTING TOOL FOR A LINER HANGER

BACKGROUND

Field

Embodiments of the present disclosure generally relate to a setting tool for actuating a liner hanger.

Description of the Related Art

Liner hangers are used to suspend a liner from another tubular string in a wellbore. Conventional hydraulic liner hangers are actuated in response to pressure above a threshold to set slips. During run-in, an increase in fluid circulation through the liner string may be necessary to facilitate moving the liner string through the deviations and/or turns of the wellbore. The increase in fluid circulation in the liner string may inadvertently actuate the liner hanger in the wellbore above the intended setting location. Unintended setting of the liner hanger results in the need to remove the liner string and to conduct a subsequent wellbore operation.

There exists a need for a liner hanger setting tool that prevents premature actuation of the liner hanger.

SUMMARY

The present disclosure generally to a setting tool for a liner hanger and a methods for completing downhole operations.

A setting tool for a downhole tool includes a tubular housing having a central bore. The setting tool further includes a first seal and a second seal disposed about an exterior of the tubular housing. The setting tool further includes a first port formed through the tubular housing and disposed between the first seal and the second seal. The setting tool further includes a first sleeve disposed in the central bore and movable from a closed position to an open position, the first sleeve having a seat. The setting tool further includes at least one first shearable member configured to releasably attach the first sleeve to the tubular housing in the closed position. The setting tool further includes a fluid bypass disposed in the tubular housing and configured to allow fluid communication around the first seal and the second seal. The central bore and the first port are in fluid communication when the first sleeve is in the open position.

A liner string includes a liner hanger assembly and a liner hanger deployment assembly. The liner hanger assembly includes a liner hanger. The liner hanger includes a plurality of slips and a liner hanger actuation assembly configured to set the plurality of slips. The liner hanger deployment assembly is disposed within the liner hanger assembly. The liner hanger deployment assembly includes a setting tool configured to selectively allow fluid communication between a central bore of the setting tool and the liner hanger actuation assembly.

A method of conducting a wellbore operation includes deploying a liner string into a wellbore to a setting depth. The liner string includes a liner hanger assembly including a liner hanger with an actuation assembly, and a liner hanger deployment assembly attached to the liner hanger assembly and including a setting tool, wherein the setting tool is configured to isolate the actuation assembly from fluid communication with a central bore of the setting tool. The method further includes actuating the setting tool to allow fluid communication between the central bore and the actuation assembly. The method further includes actuating the liner hanger.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 1A is a cross-sectional view of a liner hanger deployment assembly. FIG. 1B is a cross-sectional view of the liner hanger assembly. FIG. 1C is a cross-sectional view of the liner hanger deployment assembly within the liner hanger assembly.

FIG. 2A is a cross-sectional view of the setting tool. FIG. 2B is a cross-sectional view of FIG. 2A along line 2B-2B. FIG. 2C is a cross-sectional view of FIG. 2A along line 2C-2C. FIG. 2D is a cross-sectional view of FIG. 2A along line 2D-2D. FIG. 2E is a cross-sectional view of FIG. 2A along line 2E-2E.

FIG. 4A illustrates the liner string at a setting depth, with the setting tool disposed in the liner hanger. FIG. 4B illustrates a first object engaged with a seat of the setting tool. FIG. 4C illustrates the actuated setting tool and actuated liner hanger. FIG. 4D illustrates the first object no longer engaged with the seat. FIG. 4E illustrates a second object engaged with the seat during a cementation operation. FIG. 4F illustrates the second object no longer engaged with the seat.

FIG. 5A is a cross-sectional view of the setting tool. FIG. 5B is a cross-sectional view of FIG. 5A along line 5B-5B. FIG. 5C is a cross-sectional view of FIG. 5A along line 5C-5C.

FIG. 6A illustrates the liner string at a depth above a pressure chamber set depth, with the setting tool disposed in the liner hanger. FIG. 6B illustrates the liner string at the pressure chamber set depth. FIG. 6C illustrates the liner string at the setting depth. FIG. 6D illustrates a first object engaged with a seat of the setting tool. FIG. 6E illustrates the actuated setting tool and actuated liner hanger. FIG. 6F illustrates the first object no longer being engaged with the seat.

FIG. 7A cross-sectional view of the setting tool. FIG. 7B is a cross-sectional view of FIG. 7A along line 7B-7B. FIG. 7C is a cross-sectional view of FIG. 7A along line 7C-7C.

FIG. 8A illustrates the liner string at a setting depth, with the setting tool disposed in the liner hanger. FIG. 8B illustrates a first object engaged with a seat of the setting tool. FIG. 8C illustrates the actuated setting tool and actuated liner hanger. FIG. 8D illustrates the first object no longer being engaged with the seat. FIG. 8E illustrates a second object engaged with the seat during a cementation operation. FIG. 8F illustrates the second object no longer being engaged with the seat.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1A:
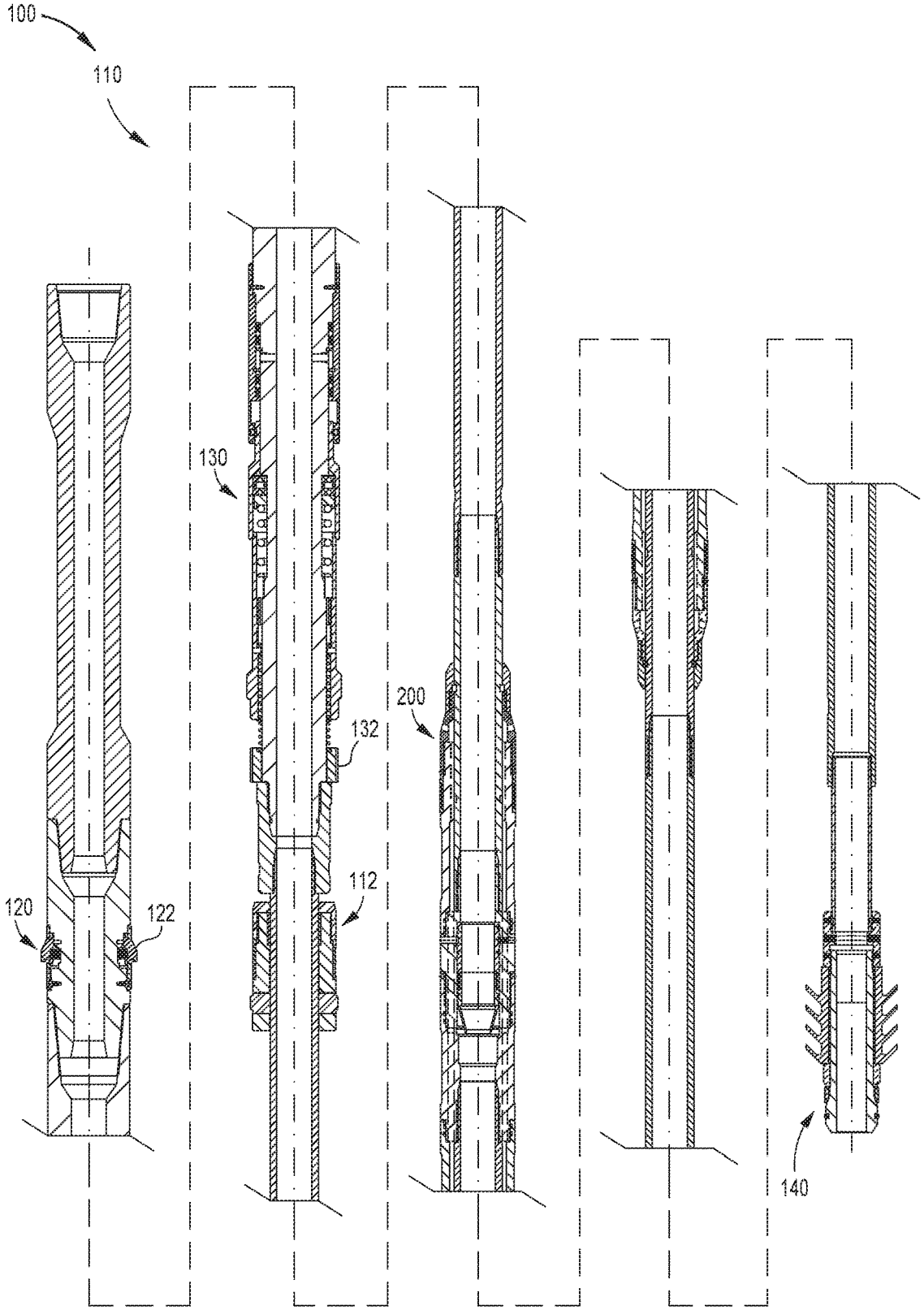
FIGS. 1A-1C illustrate a liner string according to one embodiment.
Figure 1B:
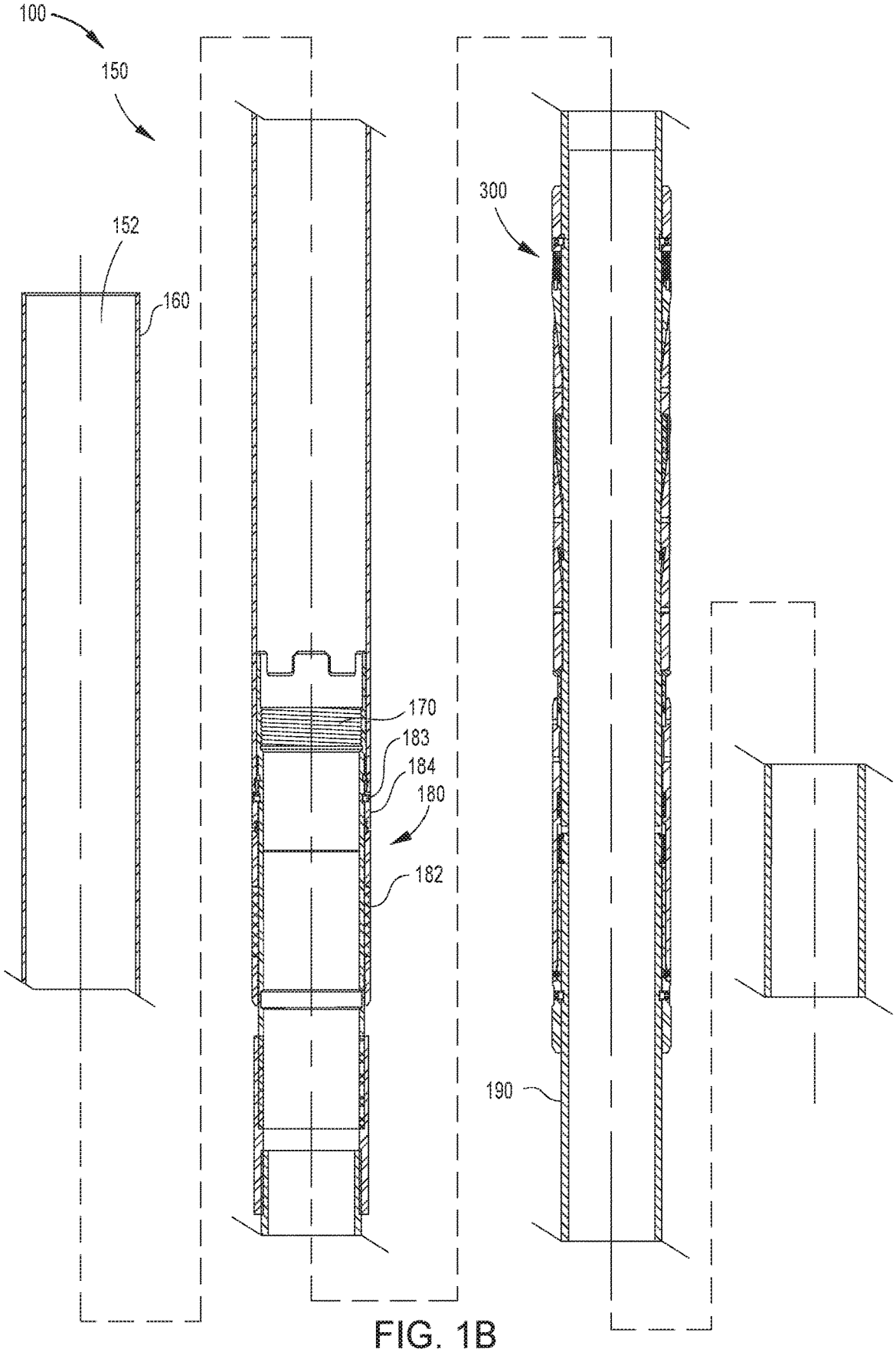
Figure 1C:
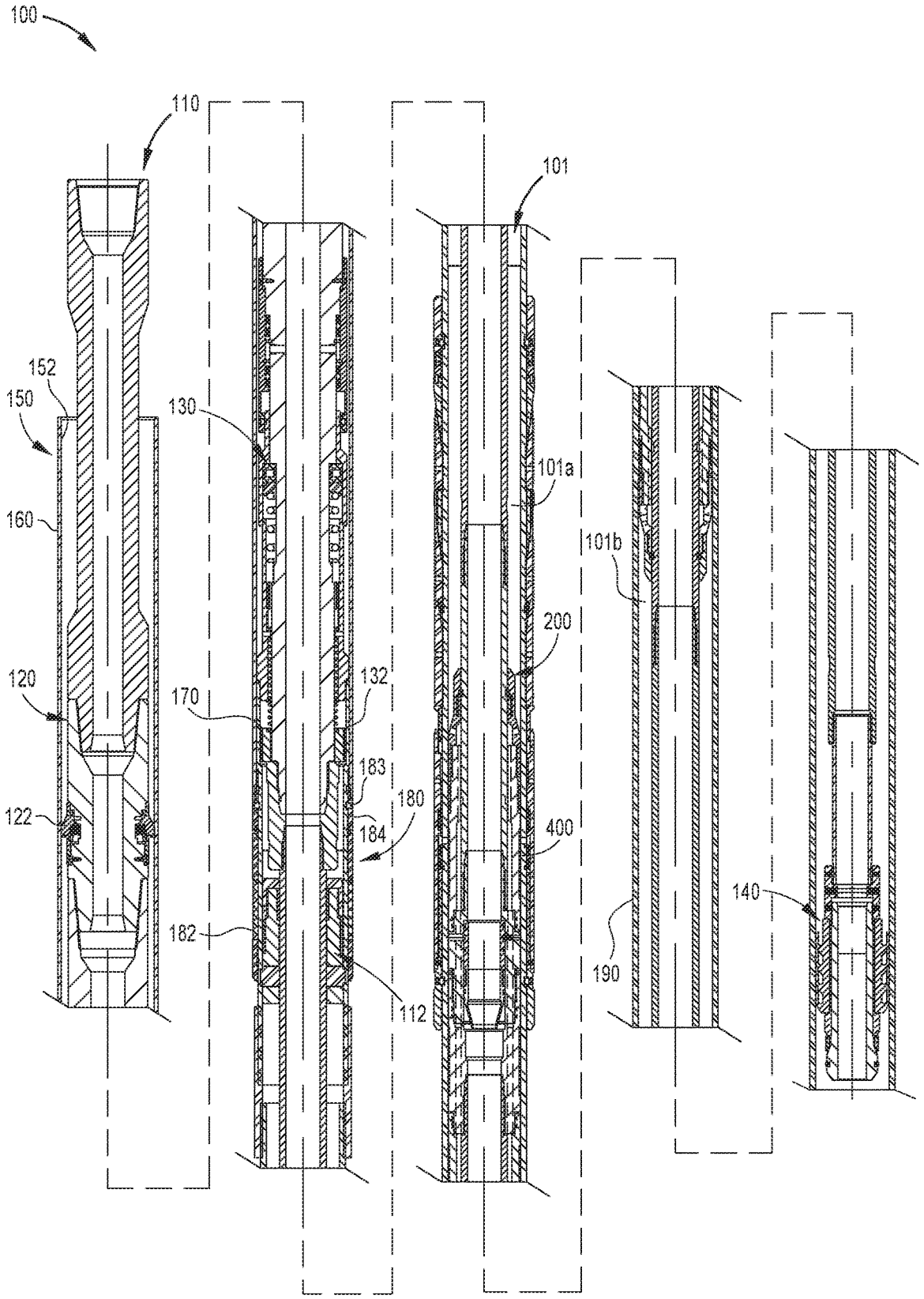

FIGS. 1A-1C illustrate a liner string 100. The liner string 100 includes a liner hanger deployment assembly (LHDA) 110, as shown in FIG. 1A, and a liner hanger assembly (LHA) 150, as shown in FIG. 1B. The LHDA 110 may include a packoff 112, a packer actuator 120, a running tool 130, a setting tool 200, and a plug assembly 140. The LHA 150 may include a polished bore receptacle (PBR) 160, threads 170, a packer 180, a liner hanger 300, and a liner 190. The LHA 150 may also include a landing collar (not shown), a float collar (not shown), and float shoe (not shown) at a lower end. FIG. 1C illustrates the LHDA 110 disposed within the LHA 150. An annulus 101 is between the LHDA 110 and the LHA 150.

During run-in of the liner string 100, the LHDA 110 is disposed in the bore 152 and releasably attached to the LHA 150. As shown in FIG. 1C, the LHDA 110 is attached to the LHA 150 via the engagement of threads 132 of the running tool 130 with the threads 170 during run-in. The LHDA 110 may be released from the LHA 150 downhole, such as by unthreading the threaded connection between threads 132 and 170. The setting tool 200 is disposed in the liner hanger 300 during run-in of the liner string 100. Circulation through the liner string 100 may be increased during run-in to facilitate moving the liner string 100 through deviations or turns in the wellbore. The setting tool 200 prevents premature actuation of the liner hanger 300 during run-in of the liner string 100. Once run-in of the liner string 100 is complete, the setting tool 200 is actuated to allow the actuation of the liner hanger 300 in response to fluid pressure. In some embodiments, the setting tool 200 can be actuated prior to the completion of run-in once the liner string 100 is close to the setting depth. After actuation of the setting tool 200, the liner hanger 300 is actuated in response to reaching a pressure threshold.

The packer 180 may include a tubular mandrel 181, a packing element 182, one or more shearable members 183, and an actuation sleeve assembly 184. The actuation sleeve assembly 183 is maintained in an initial position by the one or more shearable members 183. The PBR 160 abuts one end of the sleeve actuation assembly 184. The actuation sleeve assembly 184 is configured to compress the packing element in response to force applied to the PBR 160 from the packer actuator 120.

The packer actuator 120 may be similar to the packer actuator disclosed in U.S. Pat. No. 9,322,235, which is herein incorporated by reference. The packer actuator 120 includes a plurality of dogs 122 movable from a retracted position to an extended position. The dogs 122 are maintained in the retracted position by engagement with the inner surface of the PBR 160. In some embodiments, after the liner hanger 300 is set and the LHDA 110 is released from the LHA 150, the LHDA 110 can be lifted until the dogs 122 are withdrawn from the PBR 160 to allow the dogs 122 to move to the expanded position. The LHDA 110 may then be lowered relative to the LHA 150 until the dogs 122 seat on the top of the PBR 160. Force (e.g., weight) is then applied to the top of the PBR 160 via the dogs 122, which transfers the force to the sleeve actuation assembly 184. Once the one or more shearable members 183 shear, the actuation sleeve assembly 184 moves relative to the tubular mandrel 181 to compress the packing element 182 until it expands into engagement with the wellbore or casing surrounding the packer 180. Thus, the packer actuator 120 is used to actuate the mechanically actuated packer 180 to seal the annulus surrounding the LHA 150 by expanding the packing element 182 of the packer 180. Upon completing operations downhole, the LHDA 110 is tripped out of the wellbore. The LHA 150, however, remains in the wellbore.

Figure 2A:
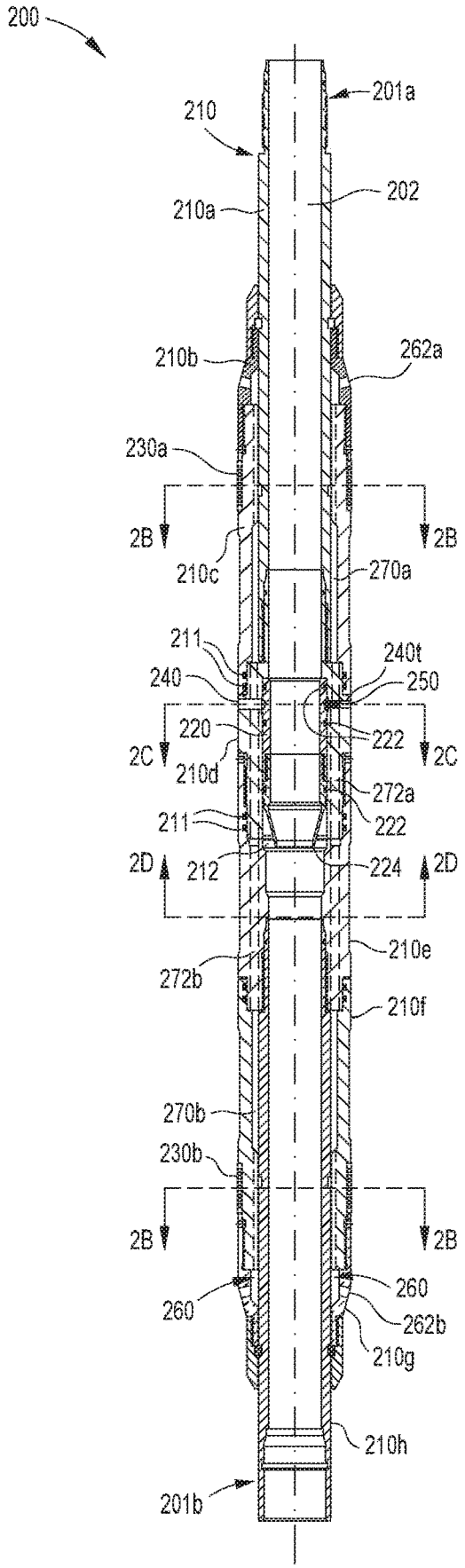
FIGS. 2A-2E illustrate an embodiment of a setting tool.

FIG. 2A illustrates an embodiment of a setting tool 200. The setting tool 200 may include a tubular housing 210, a sleeve 220, a first seal 230*a*, a second seal 230*b*, one or more ports 240, one or more shearable members 250, and a fluid bypass 260. The tubular housing 210 defines a central bore 202. To facilitate manufacturing and assembly, the tubular housing 210 may include one or more sections 210*a-h* connected together, such as by threaded couplings and/or fasteners. Seals 211 may be placed between the interconnecting tubular housing sections 210*a-h* to prevent fluid in the central bore 202 from leaking to the environment outside of the setting tool 200, and vice versa. The seals 211 maintain pressure integrity of the setting tool 200. The tubular housing 210 has a connection at each end, such as a pin 201*a* and a box 201*b*. The first seal 230*a* and the second seal 230*b* are disposed about the exterior of the tubular housing 210. The first seal 230*a* and the second seal 230*b* are configured to sealingly engage with an inner surface of the bore 152 of the LHA 150 and to straddle a port 340 of the liner hanger 300. For example, the first and second seals 230*a,b* may sealing engage with the inner surface of a tubular mandrel 310 of the liner hanger 300.

The fluid bypass 260 is disposed in the tubular housing 210. The fluid bypass extends from one or more openings 262*a* to one or more openings 262*b*. The fluid bypass 260 allows fluid communication above and below the first and second seals 230*a,b* when the seals 230*a,b* are sealingly engaged with the inner surface of the bore 152 of the LHA 150, such as the inner surface of the tubular mandrel 310 (see FIG. 4A). Thus, the fluid bypass 260 allows for fluid communication around the seals 230*a,b*. The fluid bypass 260 is not in fluid communication with the one or more ports 240.

Figure 2C:
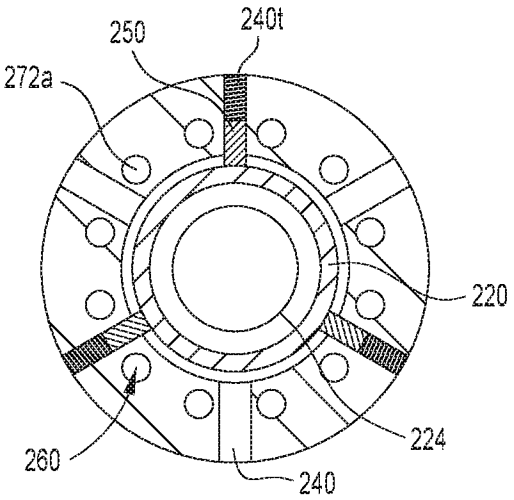
Figure 2E:
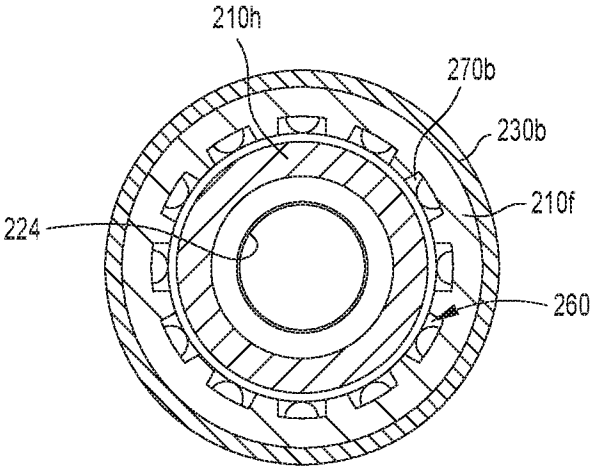
Figure 2B:
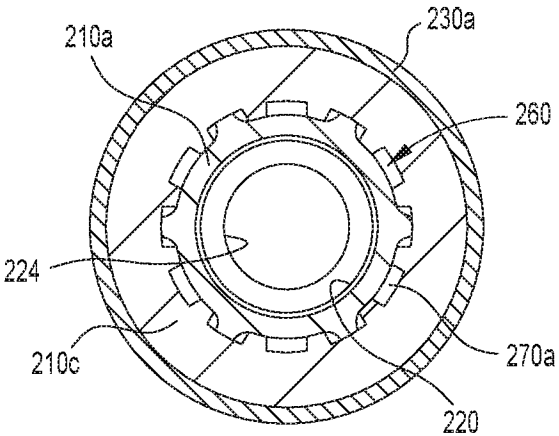
Figure 2D:
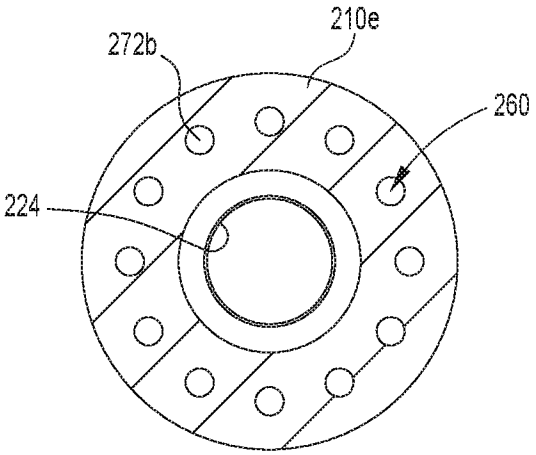

FIGS. 2B-2E show cross sections of the setting tool 200 to better illustrate the fluid bypass 260 and setting tool 200. The one or more openings 262*a* are formed in the tubular housing section 210*b*. The fluid bypass 260 can be formed from a combination of gaps between tubular sections and/or bores present in the tubular sections forming the tubular housing 210. For example, one or more gaps 270*a* may be present between the tubular housing sections 210*a* and 210*c*, and one or more gaps 270*b* may be present between tubular housing sections 210*f* and 210*h*. As shown in FIGS. 2A and 2C, one or more bores 272*a* may be formed in the tubular housing section 210*d*. As shown in FIGS. 2A and 2D, one or more bores 272*b* may be formed in the tubular housing section 210*e*. The dashed lines in tubular housing section 210*d*, as shown in FIG. 2A, illustrate the one or more bores 272*a*. The gaps 270*a,b*, the bores 272*a,b*, and the openings

262*a,b* form the fluid bypass 260. Thus, fluid may flow between openings 262*a,b* via the gaps 270*a,b* and bores 272*a,b*. In some embodiments, the number of bores 272*a* is less than the number of bores 272*b*, and vice versa. In some embodiments, the fluid bypass 260 may be a plurality of individual fluid bypasses formed in the tubular housing 210 that are isolated from one another.

The packoff 112 seals against the inner surface of the LHA 150, such as the inner surface of the packer 180. As a result, a portion 101*a* of the annulus 101 is bounded by the packoff 112 and the first seal 230*a*. A portion 101*b* of the annulus 101 is below the second seal 230*b*. The fluid bypass 260 allows the portion 101*a* of the annulus 101 between packoff 112 and first seal 230*a* to be in fluid communication with the portion 101*b* of the annulus below the second seal 230*b*. This allows the annulus portion 101*a* to fill with wellbore fluid during run-in and to equalize pressure with the annulus portion 101*b*. Without the fluid bypass 260, the annulus portion 101*a* would be isolated from the wellbore fluids. If the annulus portion 101*a* was isolated from the wellbore fluids, then a pressure difference between the annulus portion 101*a* and the annulus surrounding the outside of the LHA 150 would increase with depth, thereby increasing the risk of a collapse of the LHA 150, such as the collapse of the portion of the LHA150 between the first seal 230*a* and the packoff 112. The collapse risk is caused, in part, by the thickness and material of the LHA 150. A collapse may prevent the LHDA 110 from being tripped out of the LHA 150, which might require tripping both the LHDA 110 and LHA 150 from the wellbore. The fluid bypass 260 alleviates the pressure difference and allows the liner string 100 to be run-in to greater depths.

Prior to the actuation of the setting tool 200, fluid communication between the central bore 202 and the one or more ports 240 is blocked by the sleeve 220. Some of the ports 240 are threaded ports 240*t* for receiving a shearable member 250 that releasably attaches the sleeve 220 to the tubular housing 210. The one or more ports 240, including the threaded ports 240*t*, are formed through tubular housing 210, such as through tubular housing section 210*d*. As shown in FIGS. 2A and 2C, the shearable members 250 are disposed in the threaded ports 240*t*. However, one or all of the shearable members 250 may be disposed at another location in the tubular housing 210 instead of being disposed in the threaded ports 240*t*. The ports 240, including the threaded ports 240*t*, are disposed between the first and second seals 230*a,b*.

The sleeve 220 is disposed in the central bore 202. The sleeve 220 is movable from a closed positon (FIG. 2A) to an open position (FIG. 4C). When in the closed position, the sleeve 220 is releasably attached to the tubular housing 210, such as tubular housing section 210*d*, by the one or more shearable members 250. In some embodiments, the shearable members 250 may be threaded into a corresponding hole in the sleeve 220. In some embodiments, the shearable members 250 may be partially disposed in a groove or recess of the sleeve 220. In the open position, the shearable members 250 have sheared, and the sleeve 220 has moved relative to the tubular housing 210 to expose the one or more ports 240 to fluid communication with the central bore 202. The sleeve 220 may include one or more seals 222 disposed around the sleeve 220 to prevent fluid communication between the central bore 202 and the one or more ports 240 while the sleeve 220 is in the closed position. The sleeve 220 includes a seat 224 configured to catch a first object 410, such as a ball or a dart. The seat 224 may be coupled to the sleeve 220, such as coupled to one end of the sleeve 220, or the seat 224 may be integrally formed with the sleeve 220. A seal 222 may be disposed around the seat 224. When the first object 410 is engaged with the seat 224, pressure can be increased in the central bore 202 above the first object 410 to actuate the setting tool 200. The pressure is increased above the first object 410 until the one or more shearable members 250 are sheared, which frees the sleeve 220 to move from the closed position to the open position. The axial travel of the sleeve 220 may be limited by the abutment of the sleeve 220 with a shoulder 212 of the tubular housing 210.

Figure 3:
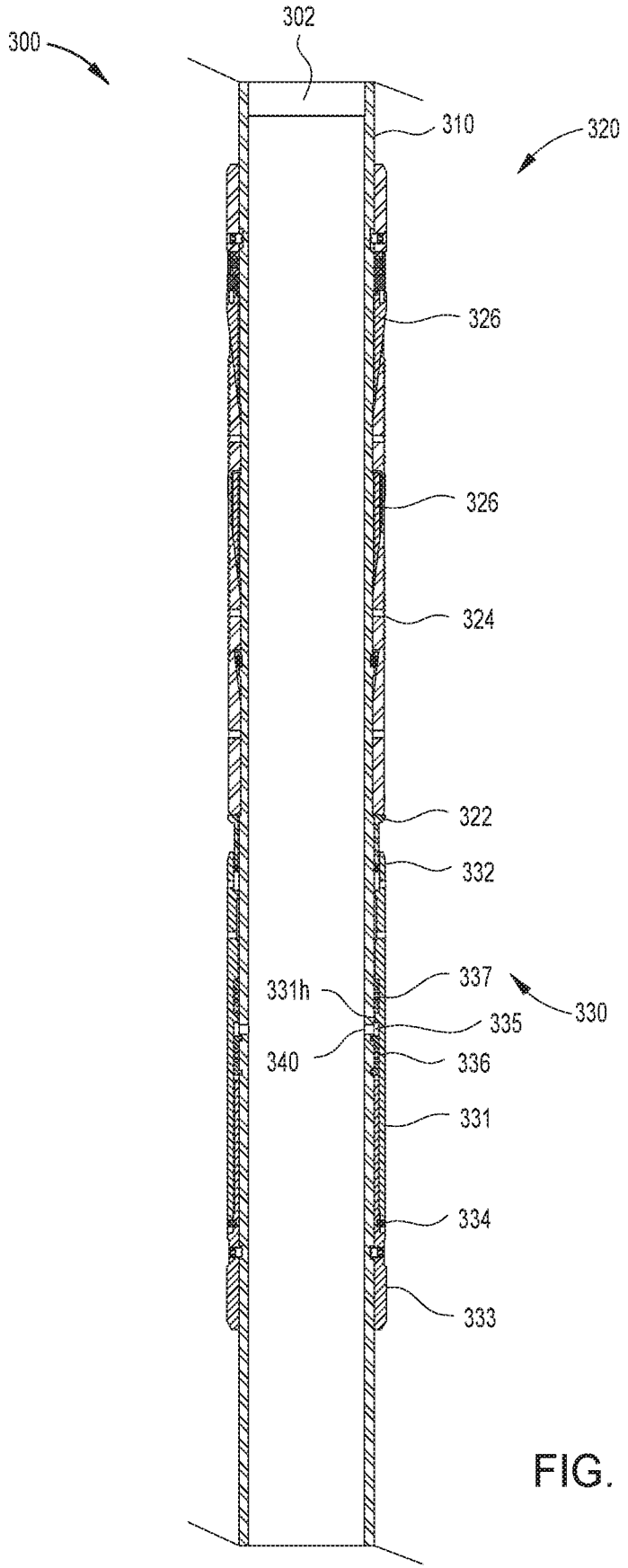
FIG. 3 is a cross-sectional view of a liner hanger according to one embodiment.

FIG. 3 illustrates an exemplary liner hanger 300. The liner hanger 300 may include the tubular mandrel 310, a slip assembly 320, and a slip actuation assembly 330. The tubular mandrel 310 defines a central bore 302 of the liner hanger 300 and includes the port 340. The liner hanger 300 can have more than one port 340. The slip assembly 320 may include a first abutment member 322 and a plurality of slips 324 configured to ride up one or more ramps 326 coupled to the tubular mandrel 310. The slip actuation assembly 330 may include a piston member 331, a second abutment member 332, a sleeve member 333, one or more shearable members 334, and a piston chamber 335 disposed between a first seal 336 and a second seal 337.

The sleeve member 333 is attached to the tubular mandrel 310, such as by a plurality of fasteners. The piston member 331 is attached to the second abutment member 332 at one end. The second seal 337 is coupled to the piston member 331. The piston member 331 is releasably attached to the sleeve member 333 via the one or more shearable members 334. In some embodiments, the one or more shearable members 250 may be configured to shear at a lower pressure than the pressure necessary to shear the one or more shearable members 334. The first seal 336 is disposed between the tubular mandrel 310 and the piston member 331, and the first seal 336 is affixed to the tubular mandrel 310. The piston chamber 335 is in fluid communication with the port 340.

In order to set the slips 324, pressure is increased in the piston chamber 335 until the force acting on the piston head 331*h* of the piston member 331 is sufficient to shear the one or more shearable members 334.

Then, the piston member 331, second seal 337, and the second abutment member 332 move, in response to the fluid in piston chamber 335, relative to the tubular mandrel 310 until the second abutment member 332 engages the first abutment member 322. Once engaged, the first abutment member 322 moves in response to the continued movement of the second abutment member 332 and piston member 331 until the slips 324 ride up the ramps 326 into engagement with a casing or an inner surface of the wellbore.

Figure 4A:
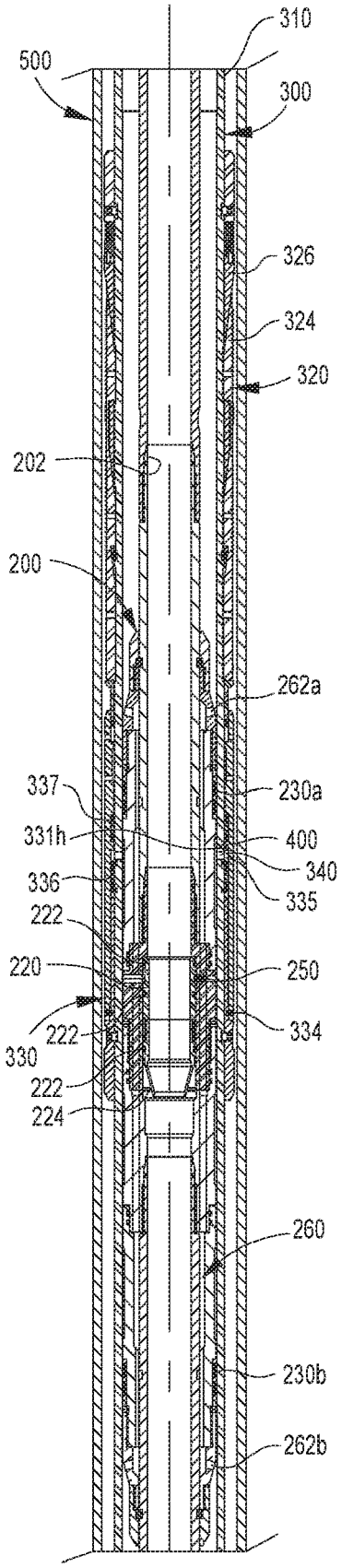
FIGS. 4A-4F are cross-sectional views of the liner string disposed in the wellbore to illustrate an exemplary operation sequence of the liner string.

FIG. 4A illustrates the setting tool 200 disposed in the central bore 302 of the liner hanger 300. The LHDA 110 is still attached to the LHA 150. The seals 230*a,b* are shown as engaged with the tubular mandrel 310. A pressure chamber 400 is disposed between the seals 230*a,b* when the seals 230*a,b* are engaged with the inner surface of the bore 152 of the LHA 150. The port 340 is disposed between the seals 230*a,b* such that it is in fluid communication with the pressure chamber 400. The pressure chamber 400 is isolated from fluid communication with the central bore 202 via the sleeve 220. The pressure chamber 400 is isolated from the annulus portions 101*a* by the first seal 230*a*. The pressure chamber 400 is isolated from the annulus portion 101*b* by the second seal 230*b*. The pressure chamber 400 may be at atmospheric pressure, or it may be pressurized to a set pressure. The pressure chamber 400, and thus the piston chamber 335, is isolated from fluid communication with the central bore 202 during run-in to avoid inadvertent actuation of the liner hanger 300.

Figure 4B:
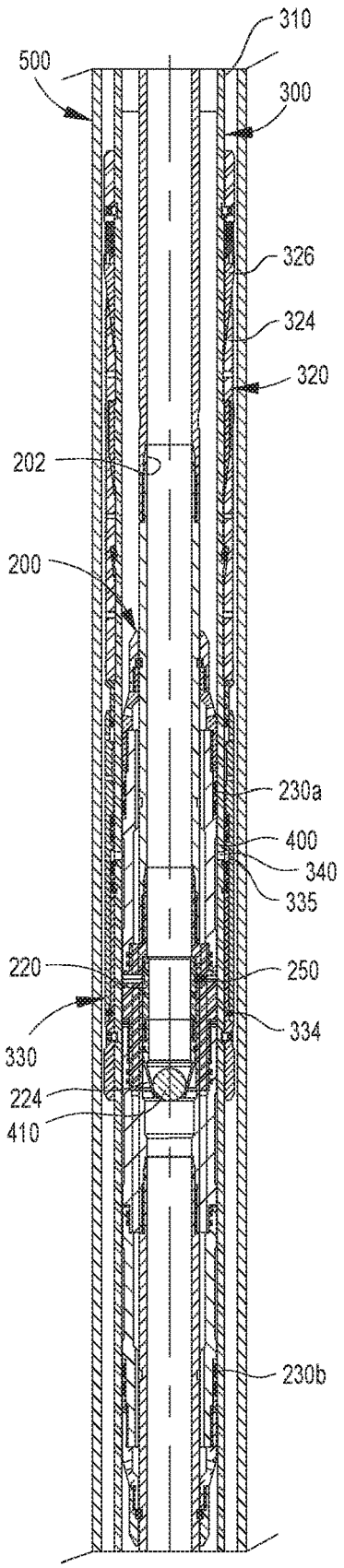
Figure 4C:
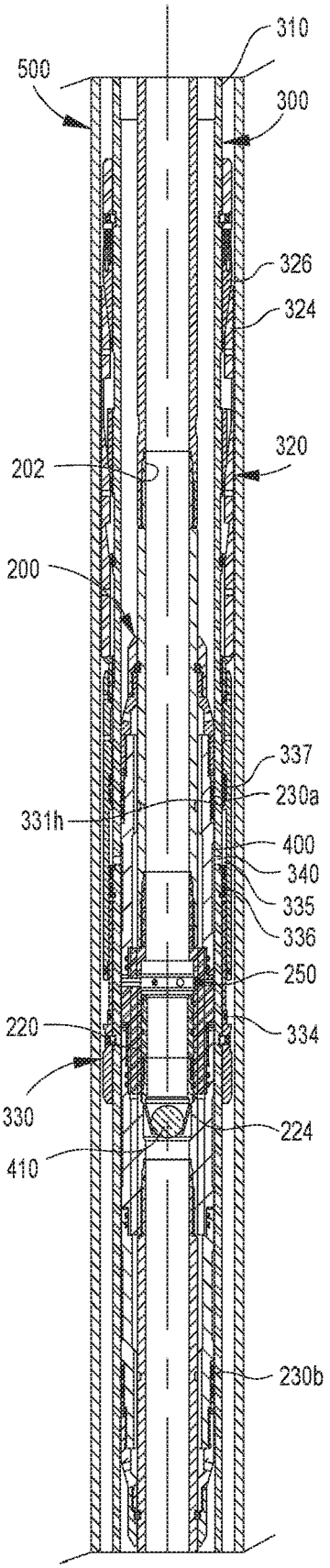
Figure 4D:
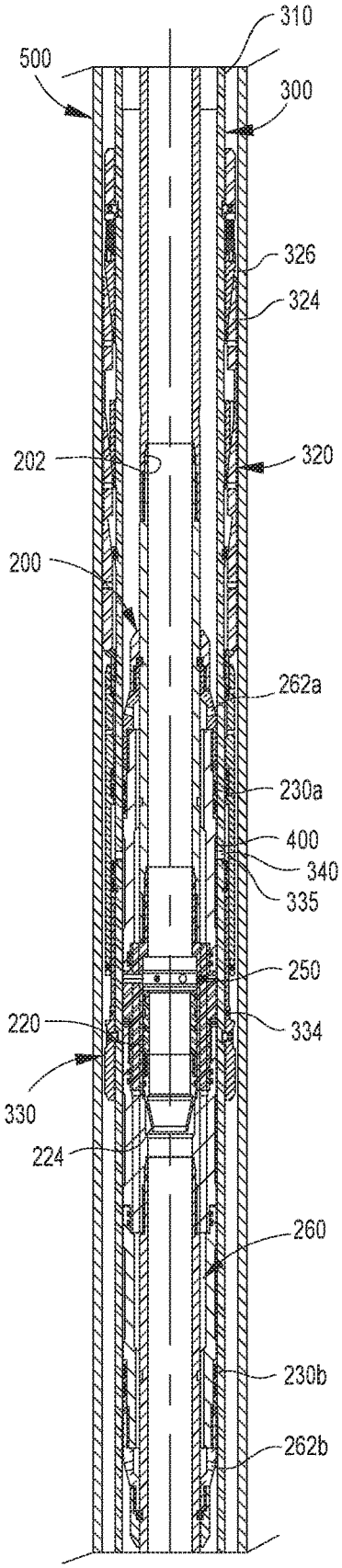

An exemplary operation sequence of the liner string 100 including the setting tool 200 and liner hanger 300 is illustrated in FIGS. 4A-4F. The setting tool 200 and the liner hanger 300 are shown disposed in a casing 500. As shown in FIG. 4A, the setting tool 200 and liner hanger 300 are at the setting depth in the wellbore. Once the liner hanger 300 is in position at the setting depth, the setting tool 200 is ready to be actuated. The first object 410 is dropped into the wellbore where it will engage with the seat 224 as shown in FIG. 4B. After the first object 410 engages the seat 224, pressure is increased above the first object 410 until the one or more shearable members 250 shear and the sleeve 220 moves from the closed position to the open position as shown in FIG. 4C. When the sleeve 220 is in the open position, fluid communication is established between the one or more ports 240 and the port 340. With the pressure chamber 400 no longer isolated from the central bore 202, the pressure chamber 400 may fill with wellbore fluid. The operator may wait a certain period of time to allow the pressure chamber 400 to fill with wellbore fluids. As shown in FIG. 4C, pressure may continue to be increased above the first object 410 until the one or more shearable members 334 shear. As a result, the slip actuation assembly 330 moves the slips 324 up the ramps 326 to the set position. However, the one or more shearable members 250 may be designed to shear at the pressure necessary to shear the one or more shearable members 334. A test may be conducted to confirm the liner hanger 300 has been set, such as by pulling or pushing on the liner string 100 from the surface to confirm that the slips 324 are set. Then, the LHDA 110 may be released from the LHA 150. In one example, the LHDA 110 is rotated relative to the LHA 150 to unthread the threaded connection between thread 132 and thread 170. Release of the LHDA 110 from the LHA 150 may be verified by lifting the LHDA 110 a predetermined distance and checking the weight on a load sensor to confirm that the LHA 150 is no longer attached. Pressure can be increased above the first object 410 until the first object 410 passes through the seat 224 as shown in FIG. 4D. The first object 410 will travel downhole, and the first object 410 may engage with or pass through the plug assembly 140 or other wellbore equipment below the seat 224. In some embodiments, the object 140 is removed from the seat 224 prior to releasing the LHDA 110 from the LHA 150.

Figure 4E:
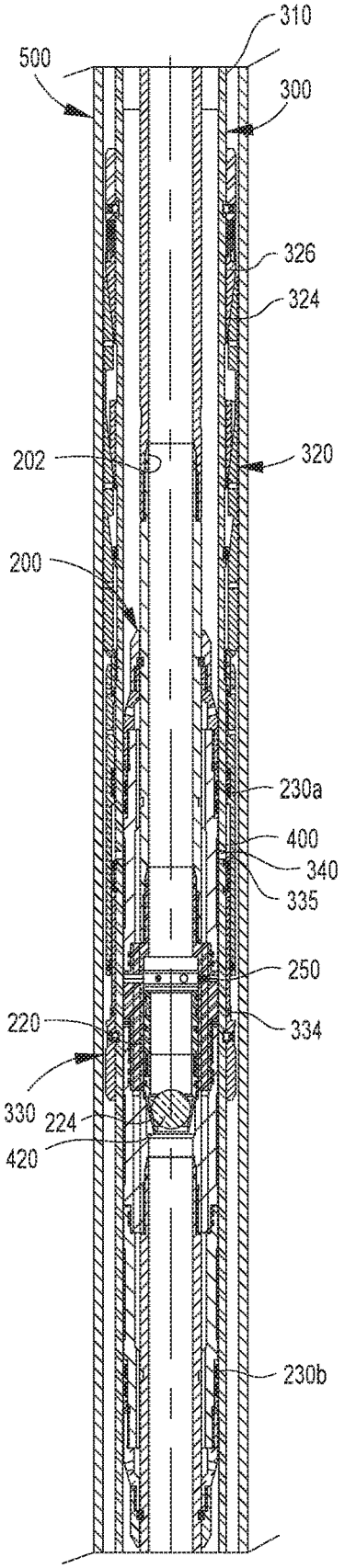
Figure 4F:
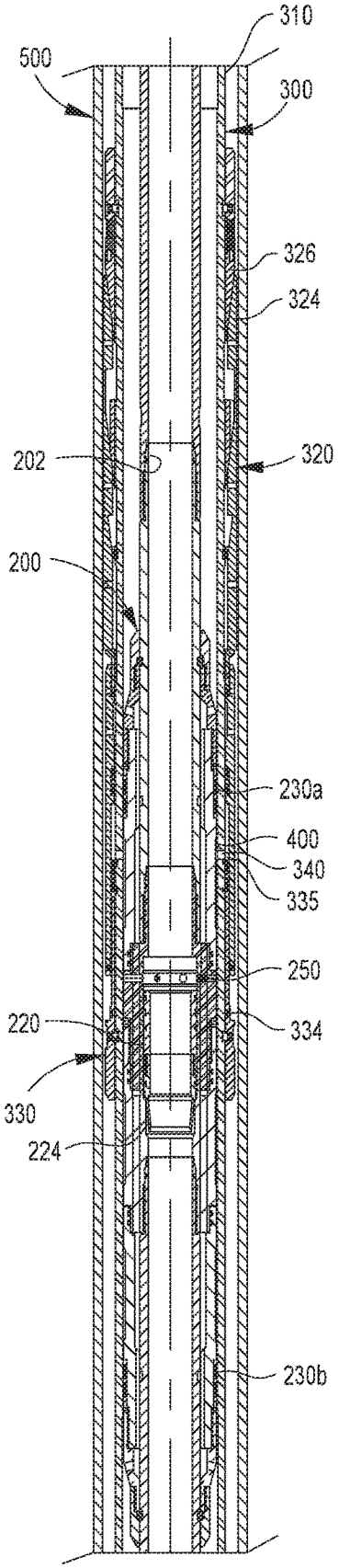

In some embodiments, once the LHDA 110 is released from the LHA 150, a cementation operation may begin. For example, a second object 420, such as a cementation dart or a ball, may be dropped into the liner string 100 above the cement. The second object 420 travels downhole until it engages the seat 224 as shown in FIG. 4E. Pressure may be increased above the second object 420, if necessary, to pass the second object through the seat 224. The second object 420 may continue to travel through the LHDA 110, and the second object 420 may engage the plug assembly 140 or other wellbore equipment below the seat 224. FIG. 4F illustrates the setting tool 200 disposed in the liner hanger 300 after the second object 420 has passed through the seat 224. Additional objects may be dropped as necessary to complete the cementation operation.

Once the cementation operation is complete, the LHDA 110 may be lifted until the dogs 122 are removed from the PBR 160, which results in the dogs 122 moving from the unexpanded position to the expanded position. Then, the LHDA 110 is lowered relative to the LHA 150 until the dogs 122 seat on the top of the PBR 160. Then, force (e.g., weight) can be applied to the LHDA 110 to set the mechanically actuated packer 180 via the dogs 122 seated on the PBR 160. After the packer 180 is set, then the LHDA 110 may be tripped out of the wellbore. In some embodiments, the packer 180 may be set without completing a cementation operation.

Figure 5A:
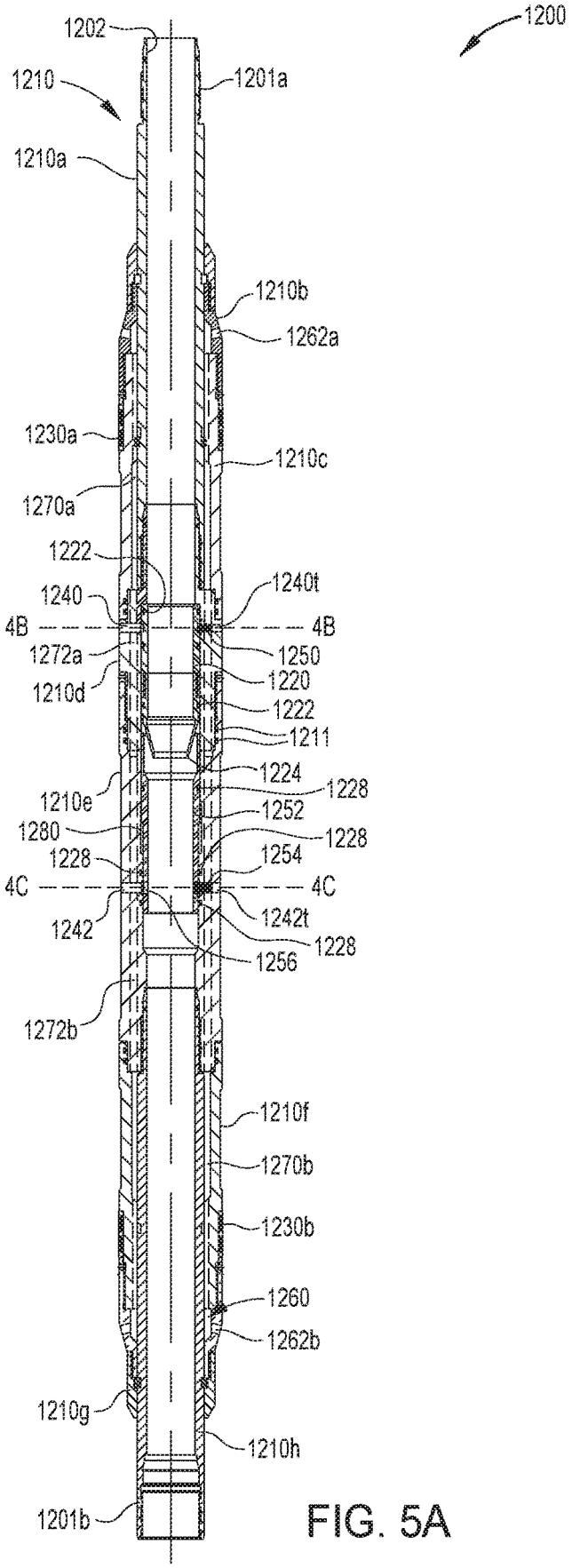
FIGS. 5A-5C illustrate an alternative embodiment of the setting tool.
Figure 5B:
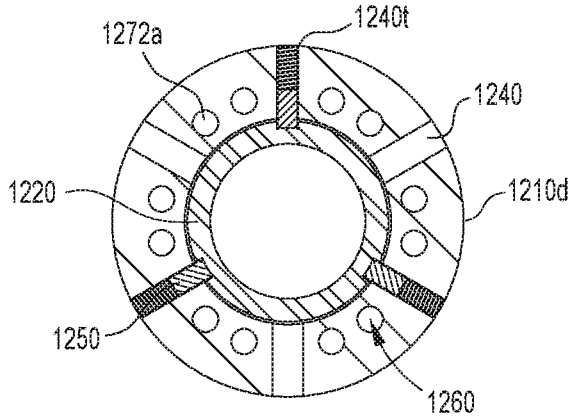
Figure 5C:
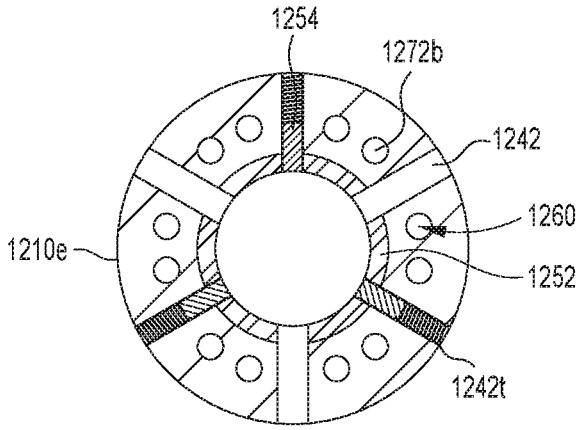

FIG. 5A-5C illustrates an alternative setting tool 1200 for use with the liner string 100. The setting tool 1200 may be substituted for the setting tool 200 in the LHDA 110. The setting tool 1200 has similar components as setting tool 200, and the similar components are identified using similar reference numbers.

FIG. 5A illustrates setting tool 1200. The setting tool 1200 may include a tubular housing 1210, a first sleeve 1220, a second sleeve 1252, a first seal 1230*a*, a second seal 1230*b*, one or more first ports 1240, one or more second ports 1242, one or more first shearable members 1250, one or more second shearable members 1254, and a fluid bypass 1260. The tubular housing 1210 defines a central bore 1202. To facilitate manufacturing and assembly, the tubular housing 1210 may include one or more sections 1210*a-h* connected together, such as by threaded couplings and/or fasteners. Seals 1211 may be placed between the interconnecting tubular housing sections 1210*a-h* to maintain the sealing and pressure integrity of the setting tool 1200. The tubular housing 1210 has a connection each end, such as a pin 1201*a* a box 1201*b*. The first seal 1230*a* and the second seal 1230*b* are disposed about the exterior of the tubular housing 1210. The first and second seals 1230*a,b* are configured to sealing engage with the inner surface of the bore 152 of the LHA 150 and to straddle the port 340 of the liner hanger 300. For example, the seals 1230*a,b* are configured to sealingly engage against the inner surface of the tubular mandrel 310 of the liner hanger 300. While the first and second seals 1230*a,b* are engaged with the inner surface of the bore 152 of the LHA 150, a pressure chamber 1400 is present between the seals 1230*a,b*.

The one or more first ports 1240 are formed through the tubular housing 1210, such as through tubular housing section 1210*d*. Some of the first ports 1240 are threaded ports 1240*t* for receiving the one or more first shearable members 1250 that releasably attach the first sleeve 1220 to the tubular housing 1210. As shown in FIGS. 5A and 5B, the one or more first shearable members 1250 are disposed in the threaded ports 1240*t*. However, the one or more first shearable members 1250 may be disposed at another location in the tubular housing 1210 instead of being disposed in the threaded ports 1240*t*. The one or more first ports 1240, including the threaded ports 1240*t*, are disposed between the first and second seals 1230*a,b*.

The first sleeve 1220 is disposed in the central bore 1202. The first sleeve 1220 is movable from a closed positon (FIG. 5A) to an open position (FIG. 6C). When in the closed position, the first sleeve 1220 is releasably attached to the tubular housing 1210, such as tubular housing section 1210*d*, by the one or more first shearable members 1250. The first sleeve 1220 includes a seat 1224 configured to catch a first object 1410, such as a ball or a dart. The seat 1224 may be coupled to the first sleeve 1220. For example, the seat 1224 can be coupled to one end of the first sleeve 1220. In another example, the seat 1224 may be integrally formed with the first sleeve 1220. A plurality of seals 1222 may be disposed around the first sleeve 1220 and the seat 224. When the first object 1410 is engaged with the seat 1224, pressure can be increased in the central bore 1202 above the first object 1410 to actuate the setting tool 1200.

The pressure is increased above the first object 1410 until the one or more first shearable members 1250 are sheared. Thereafter, the first sleeve 1220 is allowed to move from the closed position to the open position.

The second sleeve 1252 is disposed in the central bore 1202 and is releasably attached to the tubular housing 1210, such as being releasably attached to tubular housing section 1210*e*, when in the open position. One or more seals 1228 may be disposed about the second sleeve 1252, and the seals 1228 may straddle the one or more second ports 1242. When the second sleeve 1252 is in the open position (FIG. 5A), the central bore 1202 is in fluid communication with one or more second ports 1242 formed in the tubular housing 1210. In some embodiments, and as shown in FIG. 5A, the second sleeve 1252 includes one or more ports 1256 that are aligned with the one or more second ports 1242 when the second sleeve 1252 is in the open position. The one or more second ports 1242 may be formed in the tubular housing section 1210*e* and some of the one or more second ports 1242 may be threaded 1242*t*. The one or more second ports 1242, including the threaded ports 1242*t*, are disposed between the first and second seals 1230*a,b*. As shown in FIGS. 5A and 5C, the second sleeve 1252 is releasably attached to the tubular housing 1210 via one or more second shearable members 1254. In some embodiments, and as shown in FIG. 5A, the second sleeve 1252 is not pressure balanced. A chamber 1280 is disposed between the second sleeve 1252 and the tubular housing 1210. The chamber 1280 is isolated from the central bore 1202 and the one or more second ports 1242 via the seals 1228. The chamber 1280 may be at atmospheric pressure or the chamber may contain a fluid at a specific pressure, such as 500 psi (approximately 3.45 MPa) for example. As the setting tool 1200 travels deeper into the wellbore, the pressure differential between the chamber 1280 and the central bore 1202 increases. The pressure in the pressure chamber 1400 increases with depth, since the pressure chamber 1400 is in fluid communication with the central bore 1202. The pressure in the chamber 1280 and the one or more second shearable members 1254 are configured to actuate the second sleeve 1252 at a desired depth. For example, the number, thickness, and material of the one or more second shearable members 1254 and/or the pressure in the chamber 1280 can be adjusted based on the desired depth at which the second sleeve 1252 moves to the closed position. Thus, when the setting tool 1200 reaches the desired depth, the second shearable members 1254 shear due to the pressure difference between the pressure acting on the second sleeve 1252 in the central bore 1202 and the pressure in the chamber 1280. The desired depth at which the second sleeve 1252 actuates to move to the closed position is the set depth of the pressure chamber 1400. When the second sleeve 1252 is in the closed position, the pressure chamber 1400 is isolated from the central bore 1202, preventing the pressure in the pressure chamber 1400 from continuing to increase.

In some embodiments, flow rate can be used to actuate the second sleeve 1252. Fluid flow above a predetermined rate will be sufficient to increase the pressure in the central bore 1202 to act upon the second sleeve 1252 to shear the one or more second shearable members 1254. After release, the second sleeve 1252 is allowed to move to a closed position to block flow from the central bore 1202 through the one or more second ports 1242. However, the flow rate necessary to shear the one or more second shearable members 1254 and to move the second sleeve 1252 is insufficient to actuate the slip actuation assembly 330. In some embodiments, the second sleeve 1252 is actuated after catching an object in a seat of the second sleeve 1252. The second sleeve 1252 is moved to the closed position by increasing pressure above the object engaged in the seat of the second sleeve 1252 until the one or more second shearable members 1254 shear. In some embodiments, the second sleeve 1252 is pressure balanced and further includes a seat to catch an object. The second sleeve 1252 can move from the open position to the closed position in response to a pressure build-up above the object that is sufficient to shear the one or more second shearable members 1254.

The fluid bypass 1260 is disposed in the tubular housing 1210 to allow communication above and below the first and second seals 1230*a,b* when the seals 1230*a,b* are sealingly engaged with the inner surface of the bore 152 of the LHA 150, such as the inner surface of the tubular mandrel 310. Thus, the fluid bypass 1260 allows for fluid communication around the seals 1230*a,b*. The fluid bypass extends from one or more openings 1262*a* to one or more openings 1262*b*. The fluid bypass 1260 is not in fluid communication with the one or more first ports 1240 or the one or more second ports 1242. The fluid bypass 1260 allows the annulus portion 101*a* of the liner string 100 between the packoff 112 and the first seal 1230*a* to be in fluid communication with the annulus portion 101*b* below the second seal 1230*b*. Thus, annulus portion 101*a* of the annulus 101 between the packoff 112 and first seal 1230*a* can fill with wellbore fluid during run-in to achieve pressure equalization to minimize the risk of collapse of a portion of the LHA 150 between the packoff 112 and the first seal 1230*a*.

FIGS. 5B-5C show cross sections of the setting tool 1200 to better illustrate the fluid bypass 1260 and setting tool 1200. The fluid bypass 1260 can be formed from a combination of gaps and/or bores present in the tubular housing 1210. For example, one or more gaps 1270*a* may be present between the tubular housing sections 1210*a* and 1210*c* and one or more gaps 1270*b* may be present between tubular housing sections 1210*f* and 1210*h*. As shown in FIG. 5A (dashed lines) and FIG. 5B, one or more bores 1272*a* may be formed in the tubular housing section 1210*d*. As shown in FIG. 5A (dashed lines) and FIG. 5C, one or more bores 1272*b* may be formed in the tubular housing section 1210*e*. The gaps 1270*a,b*, bores 1272*a,b*, and openings 1262*a,b* form the fluid bypass 1260. In some embodiments, the number of bores 1272*a* is less than the number of bores 1272*b*, and vice versa. In some embodiments, the fluid bypass 1260 may be a plurality of individual fluid bypasses formed in the tubular housing 1210.

Figure 6A:
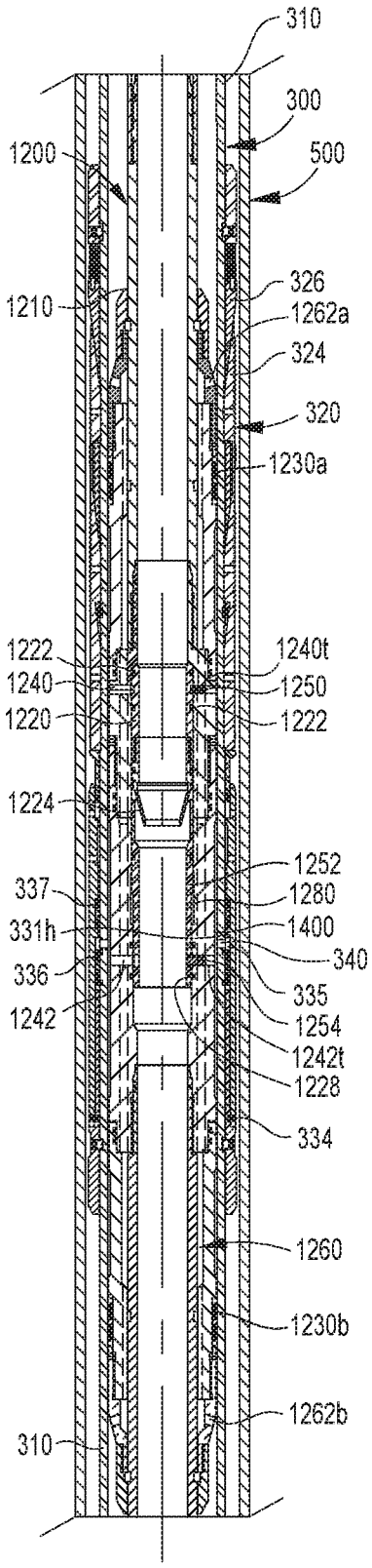
FIGS. 6A-F are cross-sectional views of the liner string disposed in the wellbore to illustrate an exemplary operation sequence of the liner string.

FIG. 6A illustrates the setting tool 1200 disposed in the liner hanger 300 when the LHDA 110 is attached to the LHA 150. The pressure chamber 1400 is isolated from the annulus portion 101*a* by the first seal 1230*a*. The pressure chamber 1400 is isolated from the annulus portion 101*b* by the second seal 1230*b*. The pressure chamber 1400 is in fluid communication with the central bore 1202 via the one or more second ports 1242 and the corresponding one or more ports 1256 of the second sleeve 1252. Thus, any fluid initially in the pressure chamber 1400, such as air, may be at least partially displaced by wellbore fluids during run-in. At the pressure chamber 1400 set depth, which is a predetermined depth, the second sleeve 1252 is actuated and moves from the open position to the closed position. After the second sleeve 1252 is actuated, the pressure chamber 1400 is isolated from the central bore 1202 by the first sleeve 1220 and the second sleeve 1252. The now isolated pressure chamber 1400 has a pressure that is equivalent to the fluid pressure at the depth where it was isolated from fluid communication with the central bore 1202 by the second sleeve 1252. After actuating the second sleeve 1252, the liner string 100 is advanced to a greater depth while the pressure chamber 1400 is isolated from fluid flow. The pressure chamber 1400 is isolated from fluid flow by the first sleeve 1220 and the second sleeve 1252 to prevent inadvertent actuation of the slip actuation assembly 330. It is believed that a greater final setting depth can be achieved than if the pressure chamber 1400 remained at its initial run-in pressure. Once the liner string 100 is at setting depth, the first object 1410 can engage with the first sleeve 1220 to actuate of the first sleeve 1220. Pressure is increased above the first object 1410 to shear the one or more first shearable members 1250, which allows the first sleeve 1220 to move to the open position. Once the first sleeve 1220 is in the open position, fluid pressure is increased until the slip actuation assembly 330 sets the slips 324.

Figure 6B:
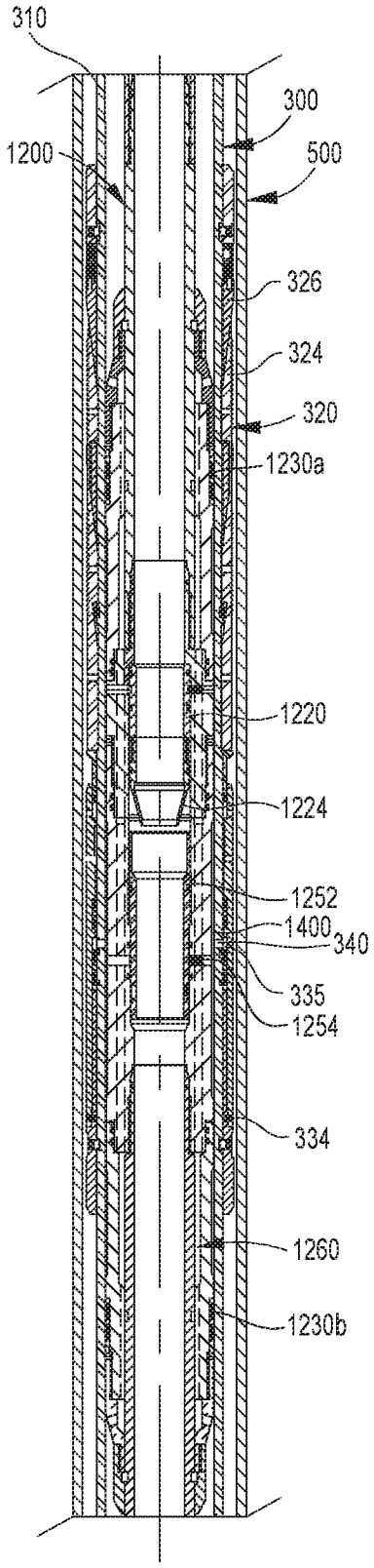
Figure 6C:
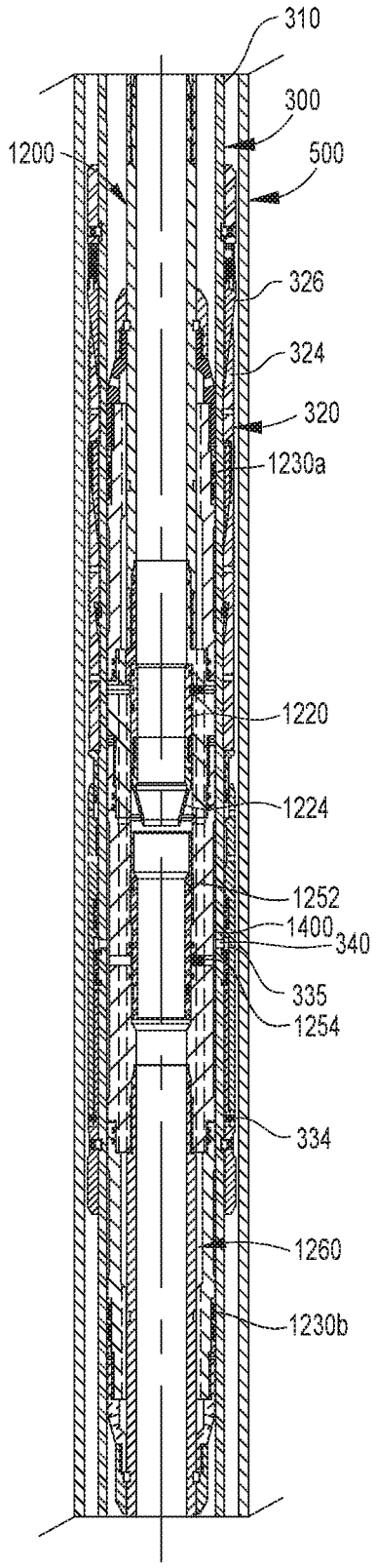
Figure 6D:
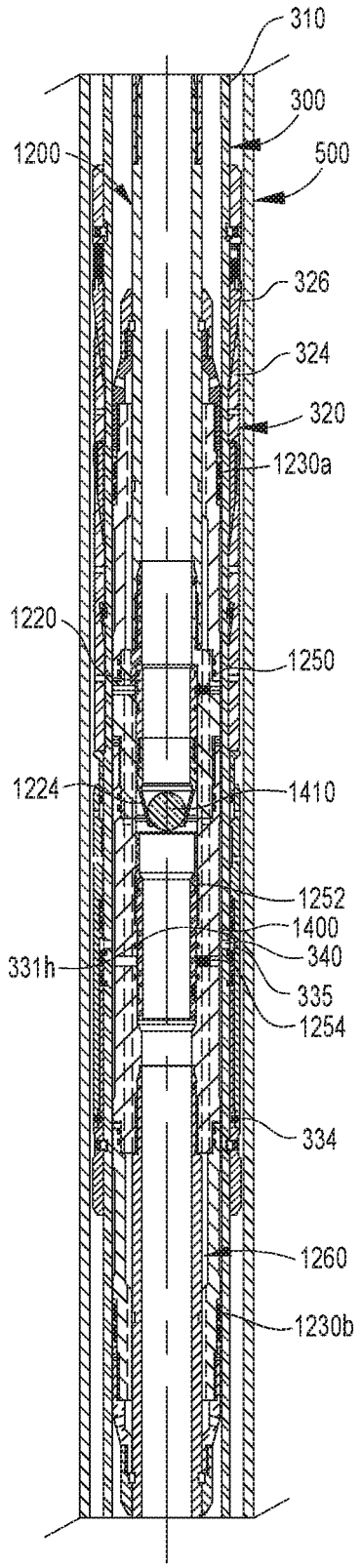
Figure 6E:
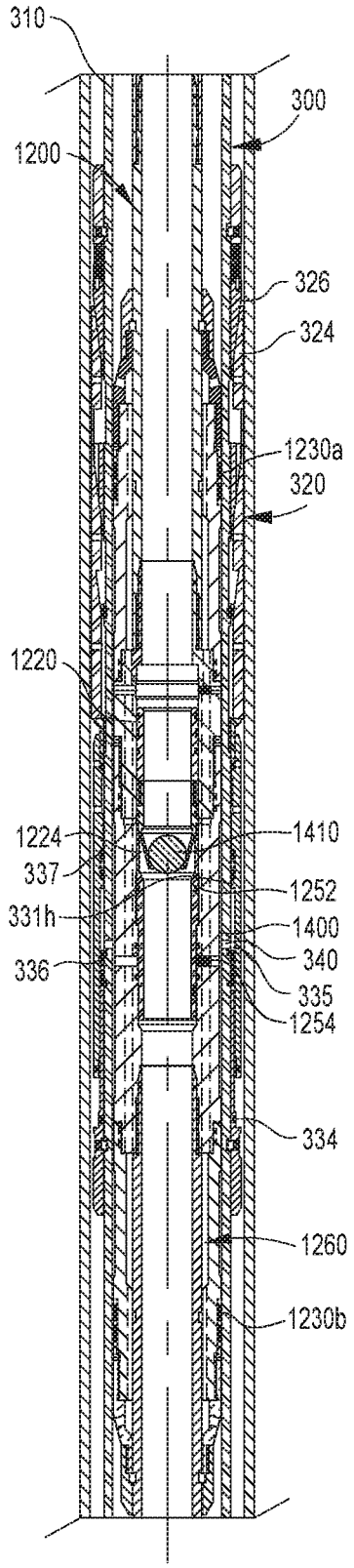
Figure 6F:
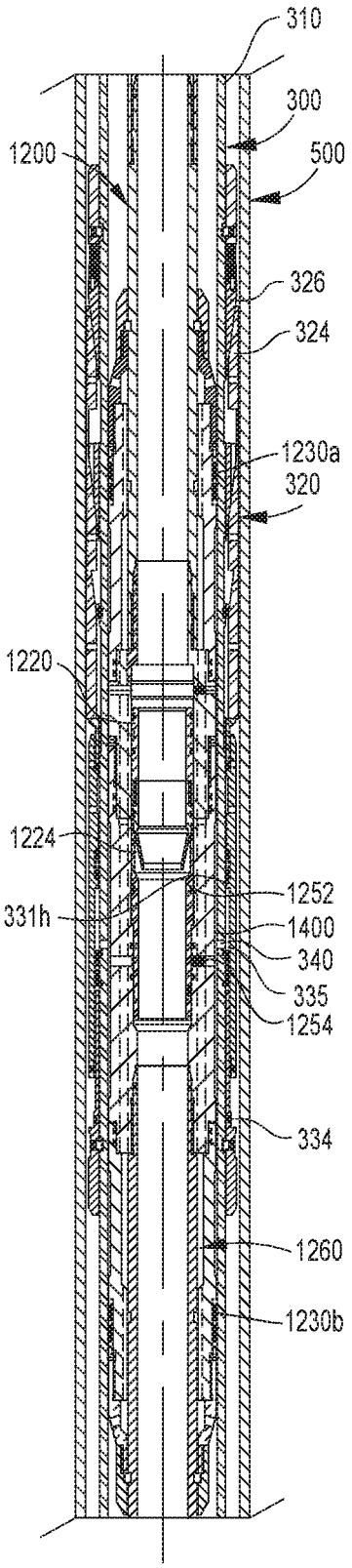

An actuation sequence of the illustrated embodiment of the setting tool 1200 and liner hanger 300 is described in FIGS. 6A-6F. The setting tool 1200 and the liner hanger 300 are shown disposed in a casing 500. FIG. 6A illustrates the setting tool 1200 and liner hanger 300 at a depth above the pressure chamber set depth. FIG. 6B illustrates the setting tool 1200 and liner hanger 300 advanced to the pressure chamber set depth, such as a depth of 10,000 ft (3,040 m). Since the pressure chamber 1400 is in communication with the central bore 1202, the pressure chamber 1400 has a pressure equivalent to the pressure at the pressure chamber set depth. Pressure chamber set depth is determined, in part, on how much deeper the liner string 100 needs to be advanced in the wellbore. After the pressure chamber 1400 set depth has been reached, the second sleeve 1252 moves to the closed position. The pressure chamber 1400 is now isolated from the central bore 1202 of the setting tool 1200. The liner string 100 can now be advanced deeper in the wellbore, such as a depth of 20,000 ft (6,096 m), without a collapse event occurring. FIG. 6C illustrates the setting tool 1200 and liner hanger 300 at setting depth, such as a depth of 20,000 ft (6,096 m). Once the liner hanger 300 is at setting depth, the first object 1410 is dropped into the wellbore. The first object 1410 engages the seat 1224 as shown in FIG. 6D. After the first object 1410 engages the seat 1224, pressure is increased above the first object 1410 to actuate the first sleeve 1220, and thus actuate the setting tool 1200. The pressure is increased above the first object 1410 until the one or more first shearable members 1250 shear and the first sleeve 1220 moves from the closed position to the open position as shown in FIG. 6E. When the first sleeve 1220 is in the open position, fluid communication is reestablished between the pressure chamber 1400 and the central bore 1202 via the one or more first ports 1240. With the pressure chamber 1400 no longer isolated, it adjusts to the new pressure present at the setting depth. As shown in FIG. 6E, pressure may continue to be increased above the first object 1410 until the one or more shearable members 334 and the slip actuation assembly 330 moves the slips 324 up the ramps 326 into the set position. However, the one or more first shearable members 1250 may be designed to shear at the same pressure as the one or more shearable members 334. A test may be conducted to confirm that the liner hanger 300 has been set, such as by pulling or pushing on the liner string 100 from the surface to confirm that the slips 324 are set. Once the operator has determined that the liner hanger 300 is set, the LHDA 110 may be released from the LHA 150, such as by rotating the LHDA 110 relative to the LHA 150 to unthread the threaded connection between threads 132 and 170. Releasing and verifying release of the LHDA 110 can be accomplished in the same manner discussed above with respect to setting tool 200. Then, pressure can be increased above the first object 1410 until the first object 1410 passes through the seat 1224 as shown in FIG. 6F. The first object 1410 may continue to travel downhole and engage the plug assembly 140 or other wellbore equipment below the seat 1224. The first object 1410 may be removed from the seat 1224 prior to releasing the LHDA 110 from the LHA 150.

In some embodiments, a cementation operation may begin after the LHDA 110 is released from the LHA 150. The cementation operation may include dropping additional objects into the wellbore that engage the plug assembly 140. Once the cementation operation is completed, then the packer 180 can be set in a similar manner as discussed above. In some embodiments, the packer 180 may be set without completing a cementation operation. Once the LHDA 110 has completed its operations, the LHDA 110 may be retrieved from the wellbore.

Figure 7A:
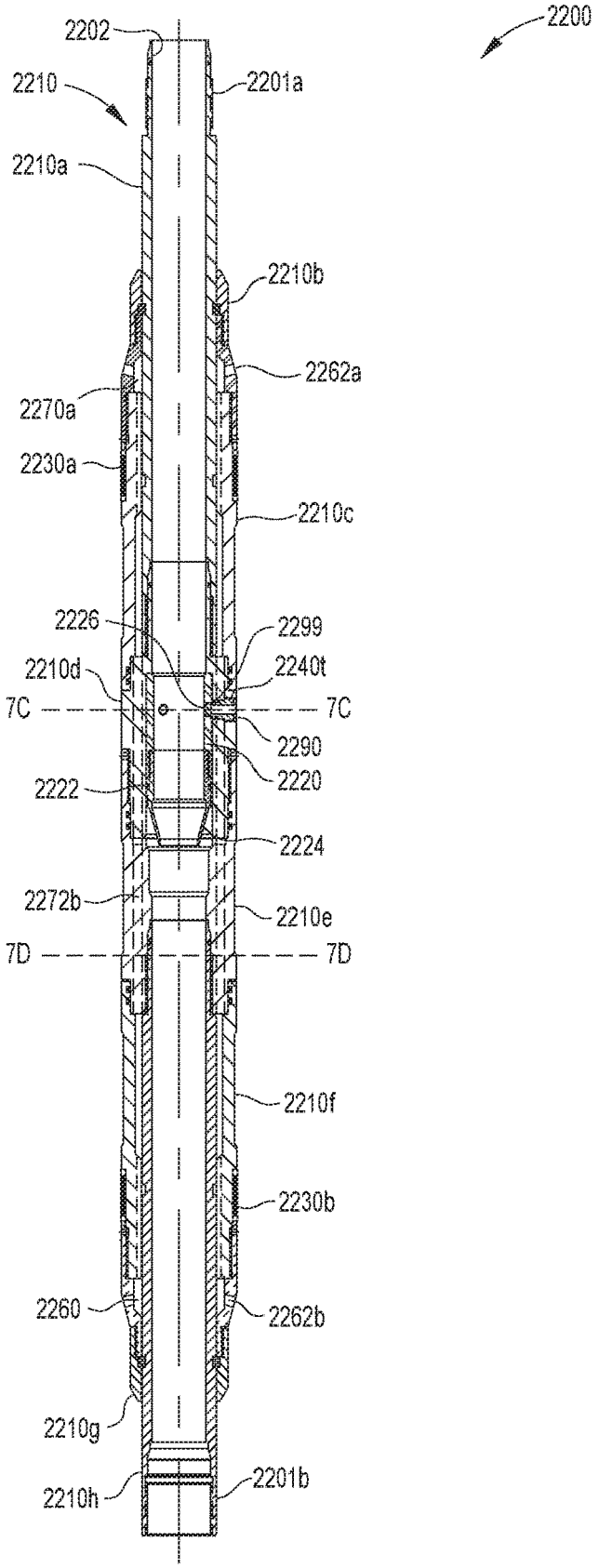
FIGS. 7A-7C illustrate another embodiment of the setting tool.
Figure 7B:
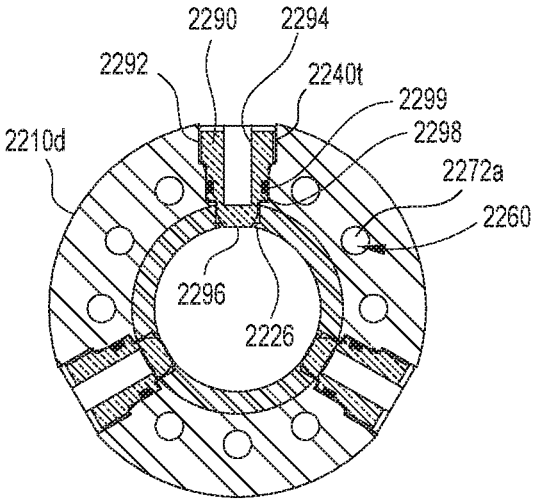
Figure 7C:
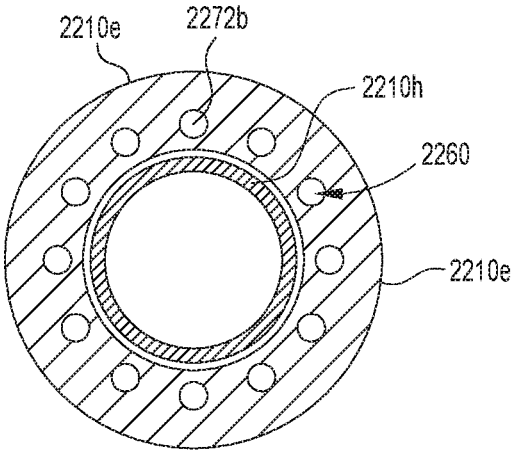

FIG. 7A-7C illustrates an alternative setting tool 2200 for the liner string 100. The LHDA 110 includes the setting tool 2200 instead of the setting tools 200 or 1200. Setting tool 2200 has similar components as setting tools 200, 1200 and the similar components are identified using similar reference signs.

The setting tool 2200 may include a tubular housing 2210, a sleeve 2220, a first seal 2230*a*, a second seal 2230*b*, one or more threaded ports 2240*t*, one or more shearable plugs 2290, and a fluid bypass 2260. The tubular housing 2210 defines a central bore 2202. To facilitate manufacturing and assembly, the tubular housing 2210 may include one or more sections 2210*a-h* connected together, such as by threaded couplings and/or fasteners. Seals 2211 may be placed between the interconnecting tubular housing sections to maintain sealing and pressure integrity of the setting tool 2200. The tubular housing 2210 has a connection each end, such as a pin 2201*a* a box 2201*b*. The one or more threaded ports 2240*t* are formed through the tubular housing 2210, such as through tubular housing section 2210*d*. The one or more threaded ports 2240*t*, are disposed between the first and second seals 2230*a,b*. The first and second seals 2230*a,b* are configured to sealing engage with the inner surface of the bore 152 of the LHA 150 and to straddle the port 340. For example, the seals 2230*a,b* may sealing engage with the inner surface of the tubular mandrel 310 of the liner hanger 300. While the first and second seals 2230*a,b* are engaged with the inner surface of the bore 152, a pressure chamber 2400 is present between the seals 2230*a,b*. In some embodiments, the pressure chamber 2400 is filled with air at atmospheric pressure. In some embodiments, the pressure chamber 2400 is filled with a fluid at a set pressure.

Figure 9:
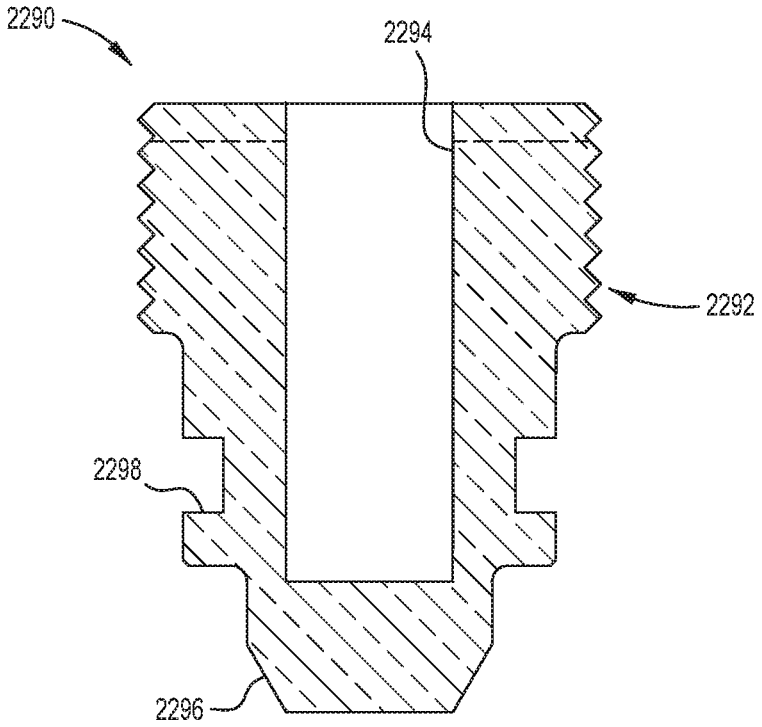
FIG. 9 illustrates a cross-section of a shearable plug according to one embodiment.

The sleeve 2220 is movable from a closed position to an open position. The sleeve 2220 includes a seat 2224 and a retainer 2226. The seat 2224 may be coupled to or integrally formed with the sleeve 2220. The retainer 2226 may be a retaining recess or a retaining bore formed through a wall of the sleeve 2220 as shown in FIG. 7A. One or more seals 2222 may be disposed about the seat 2224. The sleeve 2220 is disposed in the central bore 2202. When the sleeve 2220 is in the closed position, the sleeve 2220 is releasably attached to the tubular housing 2210 via one or more shearable plugs 2290. The shearable plugs 2290 are a shearable member. A cross section of the shearable plug 2290 is shown in FIG. 9. The shearable plugs 2290 may have threads 2292, a flow bore 2294, a closure member 2296, and a groove 2290. The threads 2292 correspond to the threads of the threaded port 2240*t*. The one or more shearable plugs 2290 are partially disposed in the one or more threaded ports 2240*t* and the retainer 2226 to hold the sleeve 2220 in the closed position. The closure member 2296 is at least partially disposed in the retainer 2226. The retainer 2226 may have threads corresponding to threads of the shearable plug 2290 located about the shearable member 2296. As shown in FIG. 9, the closure member 436 is a cap. An O-ring 1299 may be placed in the groove 1298 to seal against the inner surface of the threaded port 2240*t*.

Before the sleeve 2220 is actuated to move from the closed position to the open position, fluid communication between the central bore 2202 and the pressure chamber 2400 is blocked by the shearable plug 2290. A first object 2410, such as a ball or a dart, can be engaged with the seat 2224 to facilitate a pressure buildup above the first object 2410 in order to actuate the sleeve 2220. The one or more shearable plugs 2290 will fail along a shear plane in response to sufficient pressure such that a portion of the shearable plug 2290, such as the shearable member 2296, is sheared off by the sleeve 2220 to expose the flow bore 2294 as the sleeve 2220 moves from the closed positon to the open position. Once the flow bore 2294 is opened, a flow path is present between the central bore 2202 and the pressure chamber 2400. In some embodiments the retainer 2226 is configured to retain the sheared off portion of the shearable plug 2290, such as the closure member 2296, in order to prevent the sheared off portion from falling downhole.

The fluid bypass 2260 is disposed in the tubular housing 2210 to allow communication above and below the first and second seals 2230*a,b* when the seals 2230*a,b* are sealingly engaged with inner surface of the bore 152 of the LHA 150. Thus, the fluid bypass 2260 allows for fluid communication around the seals 2230*a,b*. The fluid bypass 2260 allows the annulus portion 101*a* of the annulus 101 of the liner string 100 between by the packoff 112 and the first seal 2230*a* to be in fluid communication with the annulus portion 101*b* below the second seal 2230*b*. Thus, the annulus portion 101*a* of the annulus between the packoff 112 and first seal 2230*a* can fill with wellbore fluid during run-in and pressure equalize to minimize the risk of collapse of a portion of the LHA 150 between the packoff 112 and the first seal 2230*a*.

FIGS. 7B-7C show cross sections of the setting tool 2200 to better illustrate the fluid bypass 2260 and setting tool 2200. The fluid bypass extends from one or more openings 2262*a* to one or more openings 2262*b*. The fluid bypass 2260 is not in fluid communication with the one or more threaded ports 2240*t*. The fluid bypass 2260 can be formed from a combination of gaps and/or bores present in the tubular housing 2210. For example, one or more gaps 2270*a* may be present between the tubular housing sections 2210*a* and 2110*c* and one or more gaps 2270*b* may be present between tubular housing sections 2210*f* and 2210*h*. As shown in FIG. 7A (dashed lines) and FIG. 7B, one or more bores 2272*a* may be formed in the tubular housing section 2210*d*. As shown in FIG. 7A (dashed lines) and FIG. 7C, one or more bores 2272*b* may be formed in the tubular housing section 2210*e*. The gaps 2270*a,b*, bores 2272*a,b*, and openings 2262*a,b* form the fluid bypass 2260. In some embodiments, the number of bores 2272*a* is less than the number of bores 2272*b*, and vice versa. In some embodiments, the fluid bypass 2260 may be a plurality of individual fluid bypasses formed in the tubular housing 2210.

In some embodiments, the one or more ports are not threaded ports 2240*t*, and the shearable plugs 2290 do not have threads 2292 and are instead fastened into one or more of the ports with one or more fasteners, such as bolts. In some embodiments, the shearable plug 2290 is made of metal. For example, the shearable plug 2290 may be brass. In some embodiments, the shearable plug 2290 may be formed from a plastic.

Figure 8A:
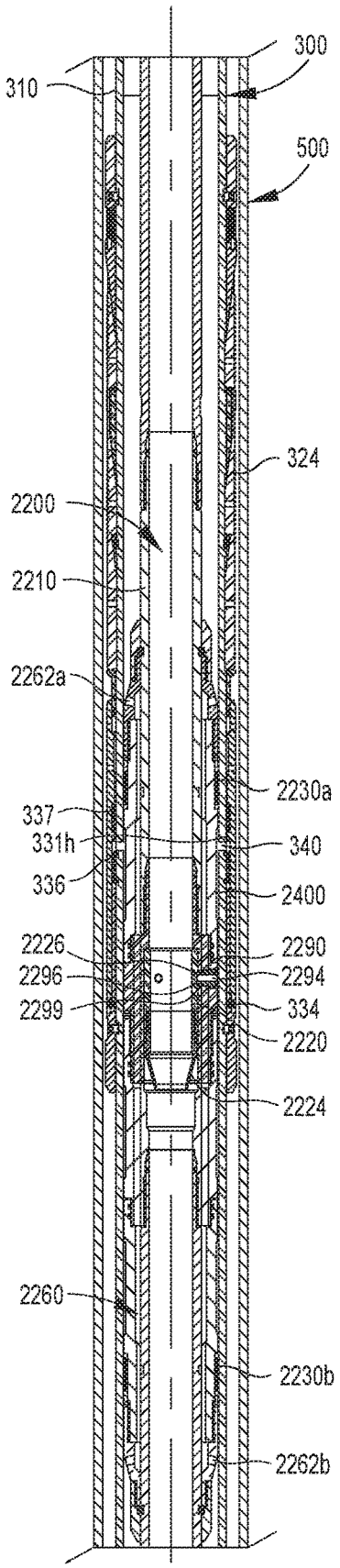
FIGS. 8A-8F are cross-sectional views of an alternative liner string disposed in the wellbore to illustrate an exemplary operation sequence of the liner string.
Figure 8B:
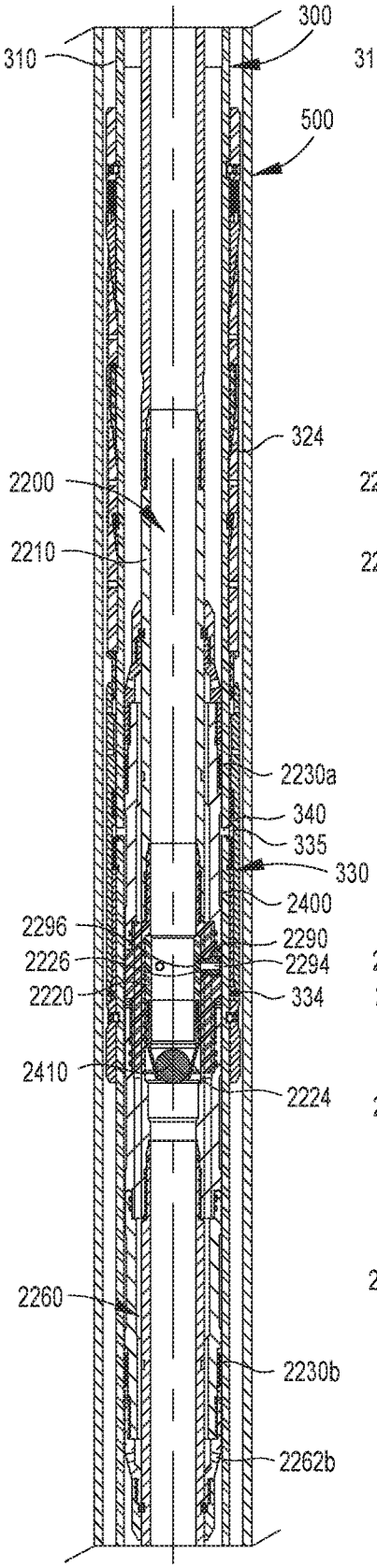
Figure 8C:
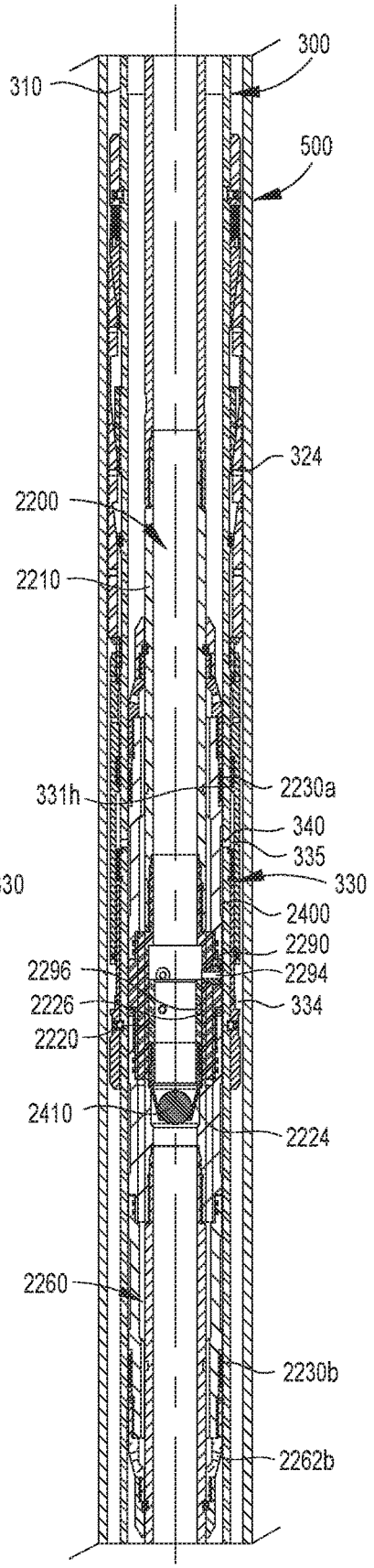

An actuation sequence of the setting tool 2200 and liner hanger 300 is described in FIGS. 8A-8F. The setting tool 2200 and liner hanger 300 are shown disposed in the casing 500 at a setting depth. As shown in FIG. 8A, the sleeve 2220 is in the closed position. The pressure chamber 2400, and thus piston chamber 335, is isolated from the central bore 2202 by the one or more shearable plugs 2290 when the sleeve 2220 is in the closed position. The pressure chamber 2400 is isolated from the annulus portion 101*a* by the first seal 2230*a*. The pressure chamber 2400 is isolated from the annulus portion 101*b* by the second seal 2230*b*. After the liner hanger 300 reaches setting depth, a first object 2410 is dropped into the wellbore where it will engage with the seat 2224 as shown in FIG. 8B. After the first object 2410 engages the seat 2224, pressure is increased above the first object 2410 to actuate the sleeve 2220. The pressure is increased until the one or more shearable plugs 2290 shear and the sleeve 2220 moves from the closed position to the open position as shown in FIG. 8C. As shown, the closure member 2296 is retained in the retainer 2226. When the sleeve 2220 is in the open position, the pressure chamber 2400, and thus piston chamber 335, is no longer isolated from the central bore 2202. Thus fluid communication is established between the central bore 2202 and the slip actuation assembly 330 via the flow bore 2294 and port 340. For example, if the pressure chamber 2400 was originally filed with air, it fills with wellbore fluids once the flow bore 2294 is exposed. As shown in FIG. 8C, pressure may continue to be increased above the first object 2410 until the one or more shearable members 334 shear and the slip actuation assembly 330 moves the slips 324 up the ramps 326 into the set position. In some embodiments, however, the one or more shearable plugs 2290 may be designed to shear at the pressure necessary to shear the one or more shearable members 334.

Figure 8D:
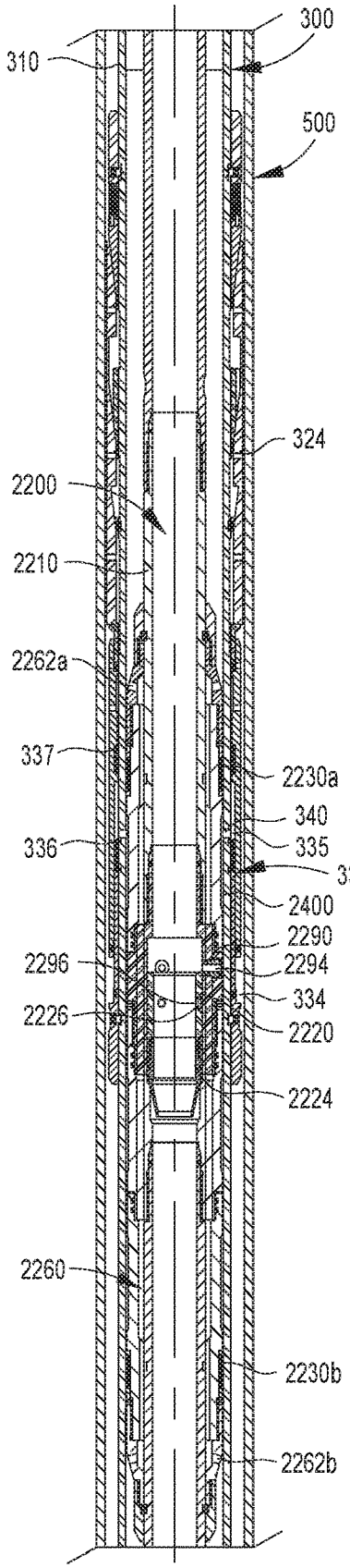

A test may be conducted to confirm that the liner hanger 300 has been set, such as by pulling or pushing on the liner string 100 from the surface to confirm that the slips 324 are set. Once the operator has determined that the liner hanger 300 is set, the LHDA 110 is released from the LHA 150. Releasing and verifying release of the LHDA 110 can be accomplished in the same manner discussed above with respect to setting tool 200. Then pressure can be increased above the first object 2410 until the first object 2410 passes through the ball seat 2224, as shown in FIG. 8D. In some embodiments, the first object 2410 may be removed from the seat 2224 prior to releasing the LHDA 110 from the LHA 150.

Figure 8E:
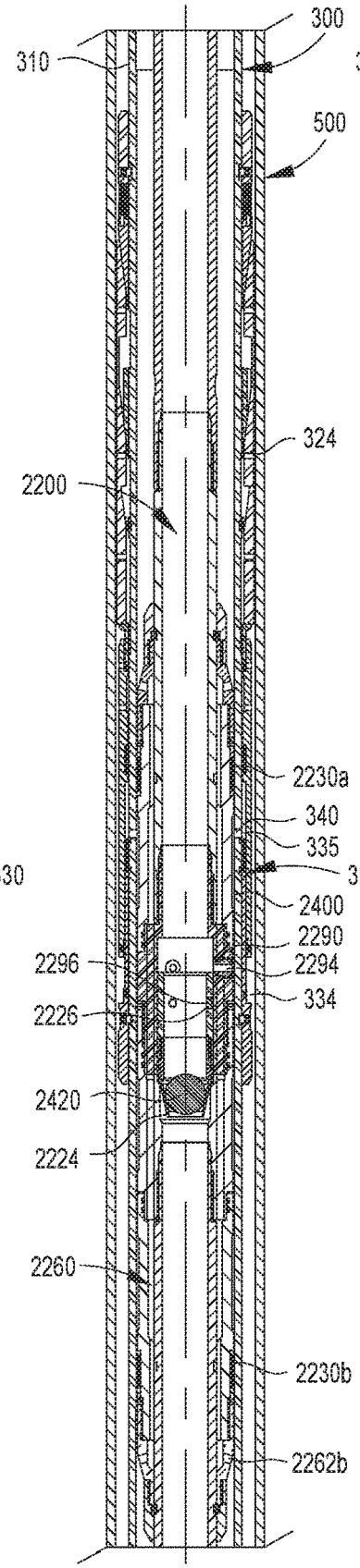
Figure 8F:
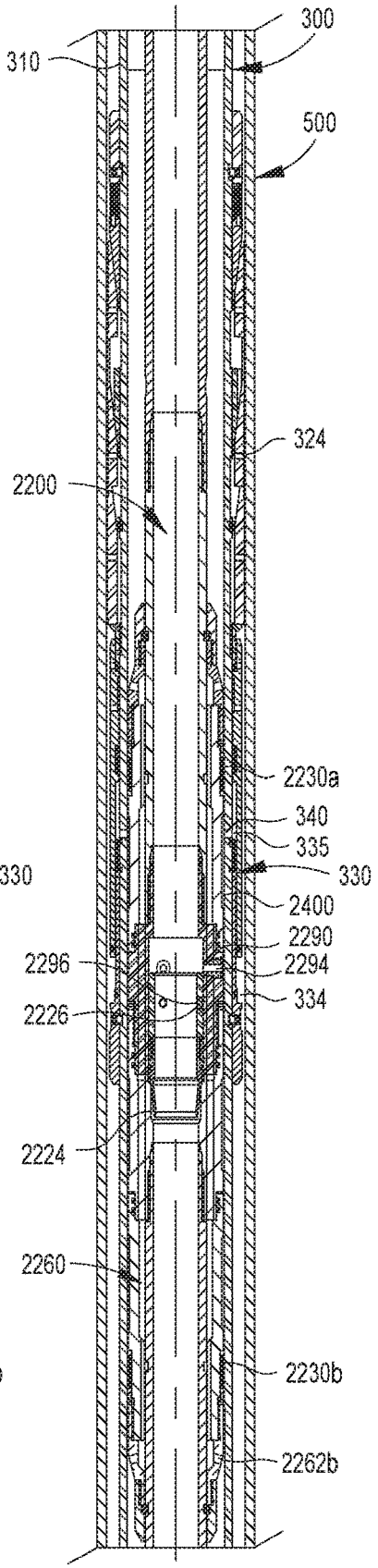

In some embodiments, a cementation operation may begin once the LHDA 110 is released from the LHA 150. For example, a second object 2420, such as a cementation dart or a ball, may be dropped into the liner string 100 above a cement. The second object 2420 travels in the liner string 100 until it engages the seat 2224, as shown in FIG. 8E. Pressure may be increased above the second object 2420, if necessary, to pass the second object through the seat 2224. The second object 2420 will continue to travel through the LHDA 110 until it engages the plug assembly 140 or other wellbore equipment below the seat 2224. FIG. 8F illustrates the setting tool 2200 disposed in the liner hanger 300 after the second object 2420 has passed through the seat 2224. Additional objects may be dropped as necessary to complete the cementation operation.

After the cementation operation is complete, the packer 180 may be set. In some embodiments, the packer 180 may be set without completing a cementation operation. Once the LHDA 110 has completed its wellbore operations, it may be retrieved from the wellbore.

In some embodiments, the setting tool 2200 includes a second set of one or more ports that are selectively blocked by a second sleeve in a similar manner as the setting tool 1200. Thus, the liner string 100 can be deployed into the wellbore with the pressure chamber 2400 in fluid communication with the central bore 2202. When a pressure chamber 2400 set depth is reached, the second sleeve is actuated to isolate the pressure chamber 2400 from the central bore 2202. The liner string 100 can be deployed further into the wellbore until the setting depth is reached. At the setting depth, the sleeve 2220 can be actuated to allow fluid communication between the pressure chamber 2400 and the central bore 2202.

While liner hanger 300 has been described, it is foreseeable that the setting tools 200, 1200, 2200 may be used to set downhole tools other than a liner hanger. For example, the setting tools 220, 1200, 2200 may be used to set a packer, and the first and second seals are straddle a port of the packer.

In some embodiments, the one or more shearable members 250, 1250, 1254 are shear screws.

An exemplary downhole operation of the liner string 100 begins by running the liner string 100 into the wellbore. Once the liner string reaches the setting depth, the respective setting tool 200, 1200, 2200 is actuated by increasing pressure above a first object 410, 1410, 2410 to allow the actuation of the liner hanger 300. Fluid pressure is increased above the first object engaged with the respective setting tool 200, 1200, 2200 until the slips 324 are set. Then a test may be conducted to confirm that the slips 324 are set. Then, the LHDA 110 may be released from the LHA 150. A test may be conducted to verify that the LHDA 110 has been released from the LHA 150. Then a cementation operation may occur. Once the cementation operation is completed, the packer 180 may be actuated. The packer 180 may be actuated by applying force (e.g., weight) to the top of the PBR 160 via dogs 122 after the LHDA 110 is lifted to allow the dogs 122 to move to the expanded position. Once the LHDA 110 has completed its wellbore operations, it may be retrieved (e.g., tripped out) since it is no longer attached to the LHA 150.

In some embodiments, the liner string 100 lands on the bottom of the wellbore. If this occurs, the liner hanger 300 might not be actuated to set the slips 324. The LHDA 110 may be released from the LHA 150 before beginning a cementation operation. Once the cementation operation is completed, the packer 180 may then be set.

In some embodiments, the cementation operation occurs before the LHDA 110 is released from the LHA 150.

In some embodiments, the slips 324 are set after the completion of the cementing operation.

In some embodiments, the liner string 100 includes a setting tool with a second sleeve, such as second sleeve 1252. The liner string 100 is first advanced to a depth sufficient to actuate (e.g., trigger) the second sleeve to isolate the downhole tool actuation assembly, such as the slip actuation assembly 330.

In some embodiments, the plug assembly 140 includes one releasable plug which is actuated in response to an object dropped from the surface, such as the object used to actuate the setting tools 200, 1200, 2200. In some embodiments, the plug assembly 140 includes more than one releasable plug, such as two releasable plugs or three releasable plugs. In some embodiments, objects dropped from the surface actuate other wellbore equipment below the setting tools 200, 1200, 2200.

In some embodiments, the running tool 130 may not have threads 132 and the LHA 150 may not have threads 170. Instead, the running tool 130 may have collets and/or dogs that engage with a profile of the LHA 150. The running tool 130 is therefore releasably attached to the LHA 150 via the engagement of the collets and/or dogs with the profile. In some embodiments, the running tool may be similar to the running tool disclosed in U.S. Pat. No. 6,241,018 which is herein incorporated by reference.

In some embodiments, the packoff 112 is disposed above the running tool 130. In some embodiments, the packoff 112 is sealingly engaged with the inner surface of the PBR 160.

In some embodiments, the LHDA 110 may include two or more setting tools to set multiple downhole tools of the LHA 150. The object used to actuate the first setting tool may be used to set the other setting tools of the LHDA 110.

A setting tool for a downhole tool includes a tubular housing having a central bore. The setting tool further includes a first seal and a second seal disposed about an exterior of the tubular housing. The setting tool further includes a first port formed through the tubular housing and disposed between the first seal and the second seal. The setting tool further includes a first sleeve disposed in the central bore and movable from a closed position to an open position, the first sleeve having a seat. The setting tool further includes at least one first shearable member configured to releasably attach the first sleeve to the tubular housing in the closed position. The setting tool further includes a fluid bypass disposed in the tubular housing and configured to allow fluid communication around the first seal and the second seal. The central bore and the first port are in fluid communication when the first sleeve is in the open position.

In some embodiment, fluid communication around the first and second seals comprises fluid communication between a first and a second opening disposed proximate opposite ends of the tubular housing, wherein the first and second seals are disposed between the first and the second openings.

In some embodiments, the tubular housing is composed of a plurality of tubular housing sections, and wherein the fluid bypass includes one or both of: one or more gaps between the tubular housing sections, and one or more bores through individual tubular housing sections.

In some embodiments, the fluid bypass is a first fluid bypass and the setting tool further includes a second fluid bypass disposed in the tubular housing and configured to allow fluid communication around the first seal and the second seal.

In some embodiments, the first sleeve blocks fluid communication between the central bore and the one or more first ports in the closed position.

In some embodiment, the setting tool includes a second port formed through the tubular housing and disposed between the first and second seals. In some embodiments, the setting tool includes a second sleeve disposed in the central bore and movable from an open position to a closed position. In some embodiments, the setting tool includes a chamber between the second sleeve and the tubular housing. The second port and the central bore are in fluid communication when the second sleeve is in the open position, and wherein fluid communication between the second port and the central bore is blocked when the second sleeve is in the closed position.

In some embodiments, the setting tool includes at least one second shearable member configured to releasably attach the second sleeve to the tubular housing in the open position.

In some embodiments, the at least one second shearable member and the chamber are configured such that the at least one second shearable member shears at a predetermined depth, and wherein the second sleeve moves to the closed position in response to a fluid pressure in the central bore.

In some embodiments, the second sleeve includes one or more sleeve ports in fluid communication with the central bore and the one or more second ports when the second sleeve is in the open position.

In some embodiments, the at least one first shearable member is at least one shearable plug, the shearable plug including a flow bore and a closure member, wherein the closure member blocks fluid communication between the central bore and the flow bore when the first sleeve is in the closed position.

In some embodiments, the closure member is configured to shear from the shearable plug to expose the flow bore to fluid communication with the central bore as the first sleeve moves to the open position.

In some embodiments, wherein the first sleeve includes a retainer configured to retain the closure member that is sheared from the shearable plug.

A liner string includes a liner hanger assembly and a liner hanger deployment assembly. The liner hanger assembly includes a liner hanger. The liner hanger includes a plurality of slips and a liner hanger actuation assembly configured to set the plurality of slips. The liner hanger deployment assembly is disposed within the liner hanger assembly. The liner hanger deployment assembly includes a setting tool configured to selectively allow fluid communication between a central bore of the setting tool and the liner hanger actuation assembly.

In some embodiments of the liner string, the setting tool further includes a first sleeve disposed in the central bore and movable from a closed position to an open position. In some embodiments, the liner string further includes a chamber in fluid communication with the liner hanger actuation assembly disposed between the setting tool and the liner hanger, wherein the chamber is isolated from the central bore when the first sleeve is in the closed position, and wherein the chamber is in fluid communication with the central bore when the first sleeve is in the open position.

In some embodiments of the liner string, the first sleeve is maintained in the closed position by one or more shearable plugs including a closed flow bore, wherein a portion of the one or more shearable plugs is sheared to open the flow bore by the movement of the first sleeve from the closed to the open position, wherein the chamber is in fluid communication with the central bore via the opened flow bore.

In some embodiments of the liner string, the setting tool further includes a first sleeve disposed in the central bore and movable from a closed position to an open position, and a second sleeve disposed in the central bore and movable from an open position to a closed position. In some embodiments, the liner string further includes a chamber in fluid communication with the liner hanger actuation assembly disposed between the setting tool and the liner hanger, wherein the chamber is isolated from the central bore when the first sleeve is in the closed position and the second sleeve is in the closed position, wherein the chamber is in fluid communication with the central bore when the first sleeve is in the closed position and the second sleeve is in the open position, and wherein the chamber is in fluid communication with the central bore when the first sleeve is in the open position and the second sleeve is in the closed position.

A method of actuating a liner hanger includes deploying a liner string including a liner hanger to a setting depth, wherein the liner string includes a setting tool disposed in the liner hanger, wherein the liner hanger includes an actuation assembly and a plurality of slips, and wherein the actuation assembly is isolated from fluid communication with a central bore of the setting tool at the setting depth. The method further includes opening a first fluid communication path between the central bore and the actuation assembly to establish fluid communication therebetween. The method further includes increasing the pressure in the central bore to actuate the actuation assembly to set the plurality of slips.

In some embodiments, the method of actuating a liner hanger includes prior to reaching the setting depth, deploying the liner string to a first depth. Upon reaching the first depth, a second fluid communication path between the central bore and the actuation assembly is closed to isolate the actuation assembly from fluid communication with the central bore.

In some embodiments, the method of actuating a liner hanger further includes retrieving the setting tool after setting the slips.

A setting tool for a downhole tool includes a tubular housing having a central bore. The setting tool further includes a first seal and a second seal disposed about an exterior of the tubular housing. The setting tool further includes a first port formed through the tubular housing and disposed between the first seal and the second seal. The setting tool further a first sleeve disposed in the central bore and movable from a closed position to an open position, the first sleeve having a seat. The setting tool further includes a shearable plug disposed in the first port and configured to releasably attach the first sleeve to the tubular housing in the closed position. The shearable plug further includes a flow bore. The shearable plug further includes a closure member blocking fluid communication between the flow bore and the central bore, wherein the closure member is configured to be sheared away to expose the flow bore to fluid communication with the central bore, wherein the closure member is sheared away by the movement of the first sleeve from the closed position to the open position.

In some embodiments of the setting tool, the first sleeve includes a retainer configured to retain the closure member that is sheared from the shearable plug.

In some embodiments, the setting tool further includes one or more second ports formed through the tubular housing and disposed between the first and second seals. In some embodiments, the setting tool further includes a second sleeve disposed in the central bore and movable from an open position to a closed position. In some embodiments, the setting tool further includes a chamber between the second sleeve and the tubular housing. In some embodiments, the setting tool further includes at least one second shearable member configured to releasably attach the second sleeve to the tubular housing in the closed position. The one or more second ports and the central bore are in fluid communication when the second sleeve is in the open position, and wherein fluid communication between the one or more second ports and the central bore is closed when the second sleeve is in the closed position.

In some embodiments of the setting tool, the at least one second shearable member and the chamber are configured such that the at least one second shearable member shears at a predetermined depth, and wherein the second sleeve moves to the closed position in response to a fluid pressure in the central bore.

In some embodiments of the setting tool, the second sleeve includes one or more sleeve ports in fluid communication with the central bore and the one or more second ports when the second sleeve is in the open position.

A method of conducting a wellbore operation includes deploying a liner string into a wellbore to a setting depth. The liner string includes a liner hanger assembly including a liner hanger with an actuation assembly, and a liner hanger deployment assembly attached to the liner hanger assembly and including a setting tool, wherein the setting tool is configured to isolate the actuation assembly from fluid communication with a central bore of the setting tool. The method further includes actuating the setting tool to allow fluid communication between the central bore and the actuation assembly. The method further includes actuating the liner hanger.

In some embodiments, the method of conducing the wellbore operation further includes releasing the liner hanger deployment assembly from the liner hanger assembly.

In some embodiments, the method of conducing the wellbore operation further includes conducting a cementation operation.

In some embodiments, the method of conducing the wellbore operation further includes setting a packer of the liner hanger assembly.

In some embodiments of the method of conducing the wellbore operation, the setting tool includes a first sleeve and a second sleeve, wherein the second sleeve is configured to actuate at a first depth to isolate the actuation assembly from the central bore, and wherein the method further includes deploying the liner string to the first depth and actuating the second sleeve prior to deploying the liner string to the setting depth.

A method of hanging a liner in a wellbore includes deploying a liner string to a setting depth in the wellbore. The liner sting includes a liner hanger having an actuation assembly, wherein the liner hanger is coupled to the liner. The liner string further includes a setting tool disposed in the liner hanger. The setting tool includes a central bore. The setting tool further includes a first sleeve having a seat, wherein the first sleeve is movable from a closed position to an open position, and wherein fluid communication between the central bore and the actuation assembly is blocked when the first sleeve is in the closed position and unblocked when the first sleeve is in the open position. The setting tool further includes one or more first shearable members configured to retain the first sleeve in the closed position. The method further includes moving the first sleeve from the closed position to the open position by engaging a first object with the seat to shear the one or more first shearable members. The method further includes actuating the actuation assembly to hang the liner.

In some embodiments of a method of hanging the liner in the wellbore, prior to reaching the setting depth, deploying the liner hanger to a first depth, wherein a second sleeve of the setting tool moves from an open positon to a closed position in response to reaching the first depth to isolate the actuation assembly from the central bore.

While the foregoing is directed to embodiments of the present disclosure, other and further embodiments of the disclosure may be devised without departing from the basic scope thereof, and the scope thereof is determined by the claims that follow.

What is claimed is:

1. A setting tool for a liner hanger, comprising:

a tubular housing having a central bore;

a first seal and a second seal, each of the first and second seals being configured to seal radially between an exterior of the tubular housing and an inner surface of a liner hanger actuation assembly to define a pressure chamber between the tubular housing and the liner hanger actuation assembly;

a first port formed through the tubular housing and disposed between the first seal and the second seal, the first port configured to be in fluid communication with the pressure chamber;

a first sleeve disposed in the central bore and movable from a closed position to an open position, the first sleeve having a seat;

at least one first shearable member configured to releasably attach the first sleeve to the tubular housing in the closed position;

a fluid bypass disposed in the tubular housing and configured to allow fluid communication around the first seal and the second seal with the fluid bypass being isolated from the pressure chamber; and wherein the central bore and the first port are in fluid communication when the first sleeve is in the open position, and wherein the first sleeve is configured to block flow between the central bore and the pressure chamber via the first port in the closed position.

2. The setting tool of claim 1, further comprising:

wherein the fluid communication around the first and second seals comprises fluid communication between a first and a second opening disposed proximate opposite ends of the tubular housing, wherein the first and second seals are disposed between the first and the second openings.

3. The setting tool of claim 1, further comprising:

wherein the fluid bypass is a first fluid bypass; and a second fluid bypass disposed in the tubular housing and configured to allow fluid communication around the first seal and the second seal.

4. The setting tool of claim 1, wherein the first sleeve blocks fluid communication between the central bore and the first port in the closed position.

5. The setting tool of claim 1, further comprising:

a second port formed through the tubular housing and disposed between the first and second seals;

a second sleeve disposed in the central bore and movable from an open position to a closed position;

a chamber between the second sleeve and the tubular housing; and wherein the second port and the central bore are in fluid communication when the second sleeve is in the open position, and wherein fluid communication between the second port and the central bore is blocked when the second sleeve is in the closed position.

6. The setting tool of claim 5, further comprising:

at least one second shearable member configured to releasably attach the second sleeve to the tubular housing in the open position.

7. The setting tool of claim 6, wherein the at least one second shearable member and the chamber are configured such that the at least one second shearable member shears at a predetermined depth, and wherein the second sleeve moves to the closed position in response to a fluid pressure in the central bore.

8. The setting tool of claim 5, wherein the second sleeve includes one or more sleeve ports in fluid communication with the central bore and the one or more second ports when the second sleeve is in the open position.

9. The setting tool of claim 1, wherein the at least one first shearable member is at least one shearable plug, the shearable plug including a flow bore and a closure member, wherein the closure member blocks fluid communication between the central bore and the flow bore when the first sleeve is in the closed position.

10. The setting tool of claim 9, wherein the closure member is configured to shear from the shearable plug to expose the flow bore to fluid communication with the central bore as the first sleeve moves to the open position.

11. The setting tool of claim 10, wherein the first sleeve includes a retainer configured to retain the closure member that is sheared from the shearable plug.

12. A liner string, comprising:

a liner hanger assembly including a liner hanger, the liner hanger including:

a plurality of slips; and a liner hanger actuation assembly configured to set the plurality of slips;

a liner hanger deployment assembly disposed within the liner hanger assembly, the liner hanger deployment assembly including:

a setting tool configured to selectively allow fluid communication between a central bore of a tubular housing of the setting tool and the liner hanger actuation assembly, the setting tool further includes:

a port formed through the tubular housing; and a first sleeve disposed in the central bore and movable from a closed position to an open position, and wherein fluid communication from the central bore to the liner hanger actuation assembly through the port is blocked when the first sleeve is in the closed position.

13. The liner string of claim 12, further comprising:

a chamber in fluid communication with the liner hanger actuation assembly disposed between the setting tool and the liner hanger, wherein the chamber is isolated from the central bore when the first sleeve is in the closed position, and wherein the chamber is in fluid communication with the central bore when the first sleeve is in the open position.

14. The liner string of claim 13, wherein the first sleeve is maintained in the closed position by one or more shearable plugs partially disposed in the port including a closed flow bore, wherein a portion of the one or more shearable plugs is sheared to open the flow bore by the movement of the first sleeve from the closed position to the open position, wherein the chamber is in fluid communication with the central bore via the opened flow bore.

15. The liner string of claim 12, further comprising:

the setting tool further comprising:

a second sleeve disposed in the central bore and movable from an open position to a closed position; and a chamber in fluid communication with the liner hanger actuation assembly disposed between the setting tool and the liner hanger, wherein the chamber is isolated from the central bore when the first sleeve is in the closed position and the second sleeve is in the closed position, wherein the chamber is in fluid communication with the central bore when the first sleeve is in the closed position and the second sleeve is in the open position, and wherein the chamber is in fluid communication with the central bore when the first sleeve is in the open position and the second sleeve is in the closed position.

16. A method of conducting a wellbore operation with the setting tool of claim 1, comprising:

deploying the liner string into a wellbore to a first depth, wherein the liner string includes:

a liner hanger assembly including a liner hanger with the liner hanger actuation assembly; and a liner hanger deployment assembly attached to the liner hanger assembly and including the setting tool, wherein the setting tool is configured to isolate the liner hanger actuation assembly from fluid communication with the central bore of the setting tool at the first depth;

deploying the liner string to a setting depth while the central bore is isolated from the pressure chamber;

actuating the setting tool, thereby permitting fluid communication between the central bore and the liner hanger actuation assembly via the pressure chamber; and actuating the liner hanger.

17. The method of claim 16, further comprising:

releasing the liner hanger deployment assembly from the liner hanger assembly.

18. The method of claim 16, further comprising:

conducting a cementation operation.

19. The method of claim 18, further comprising:

setting a packer of the liner hanger assembly.

20. The method of claim 16, wherein the setting tool includes a second sleeve, wherein the second sleeve is configured to actuate at the first depth to isolate the actuation assembly from the central bore, and wherein the method further includes deploying the liner string to the first depth and actuating the second sleeve prior to deploying the liner string to the setting depth.

* * * * *